US006494850B1

(12) United States Patent
Kitadou et al.

(10) Patent No.: US 6,494,850 B1
(45) Date of Patent: Dec. 17, 2002

(54) RELAXATION APPARATUS

(75) Inventors: Masako Kitadou, Moriguchi (JP); Kazunori Araki, Nara (JP); Tatsuya Takahashi, Moriguchi (JP); Kazumi Okawa, Hikone (JP); Suehisa Kishimoto, Hikone (JP); Yuuki Yoda, Hikone (JP)

(73) Assignee: Matsushita Electric Works, Ltd., Osaka (JP)

( * ) Notice: Subject to any disclaimer, the term of this patent is extended or adjusted under 35 U.S.C. 154(b) by 0 days.

(21) Appl. No.: 09/546,709

(22) Filed: Apr. 10, 2000

Related U.S. Application Data

(63) Continuation-in-part of application No. 08/943,808, filed on Oct. 3, 1997.

(30) Foreign Application Priority Data

Oct. 7, 1996 (JP) ..... 8-266339
Sep. 2, 1997 (JP) ..... 9-236633

(51) Int. Cl.[7] ..... A61H 1/00

(52) U.S. Cl. ..... 601/49; 601/53; 601/54; 601/90; 601/91; 601/92; 601/93

(58) Field of Search ..... 601/46, 49, 51, 601/53, 54, 56, 58, 59, 89–93, 98

(56) References Cited

U.S. PATENT DOCUMENTS

| | | | | |
|---|---|---|---|---|
| 2,570,676 A | | 10/1951 | Henderson | |
| 3,532,089 A | | 10/1970 | Arntzenius | |
| 3,826,250 A | | 7/1974 | Adams | |
| 4,133,305 A | | 1/1979 | Steuer | |
| 4,256,095 A | | 3/1981 | Graham | |
| 4,586,492 A | | 5/1986 | Manahan | |
| 4,947,832 A | | 8/1990 | Blitzer | |
| 5,086,769 A | | 2/1992 | Vianello et al. | |
| 5,186,424 A | * | 2/1993 | Schultz et al. | 248/179 |
| 5,273,028 A | * | 12/1993 | McLeod et al. | 601/98 |
| 5,301,661 A | | 4/1994 | Lloyd | |
| 5,376,065 A | * | 12/1994 | McLeod et al. | 601/98 |
| 5,520,614 A | | 5/1996 | McNamara et al. | |
| 5,713,832 A | * | 2/1998 | Jain | 601/49 |
| 5,993,401 A | * | 11/1999 | Inbe et al. | 601/46 |

FOREIGN PATENT DOCUMENTS

| | | |
|---|---|---|
| JP | 3-70573 | 3/1991 |
| JP | 4-216743 | 8/1992 |
| JP | 5-293172 | 11/1993 |
| JP | 8-242972 | 9/1996 |

OTHER PUBLICATIONS

English Language Abstract of JP 3–70573.
English Language Abstract of JP 4–216743.
English Language Abstract of JP 5–293172.
English Language Abstract of JP 8–242972.

* cited by examiner

*Primary Examiner*—Michael A. Brown
*Assistant Examiner*—Benjamin K. Koo
(74) *Attorney, Agent, or Firm*—Greenblum & Bernstein, P.L.C.

(57) ABSTRACT

A relaxation apparatus which comprises a reclining chair for supporting thereon a whole body of a person who desires relaxation. The person resting on the reclining chair is cyclically vibrated at a frequency not higher than 25 Hz. A control is provided for controlling the vibrating device. The maximum absolute value of acceleration of the vibration produced by the vibrating device to vibrate the person supported on the reclining chair is not greater than 0.1 G. The control controls the acceleration in dependence on the frequency of vibrations outputted by the vibrating device such that the acceleration is small when the frequency of vibrations outputted by the vibrating device is low while the acceleration is large when the frequency of vibrations is high.

15 Claims, 27 Drawing Sheets

Pitching Vibration at 0.5Hz
Unacceptable Acceleration Level (0.04G)

Riding Comfort with Body moved up and down

Riding Comfort with Body moved laterally

Riding Comfort with Body moved back-and-forth

Fig.37
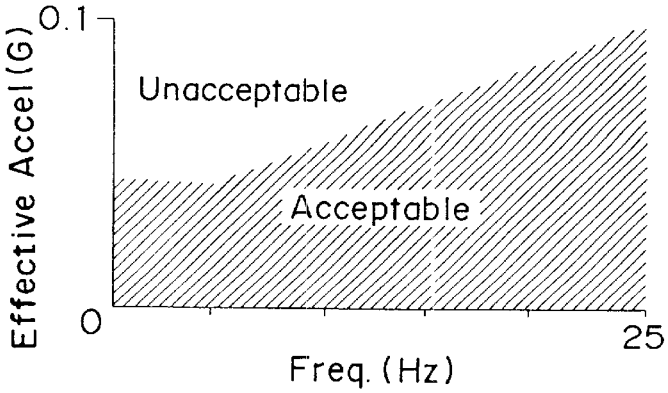
Fig.38A
Fig.38B
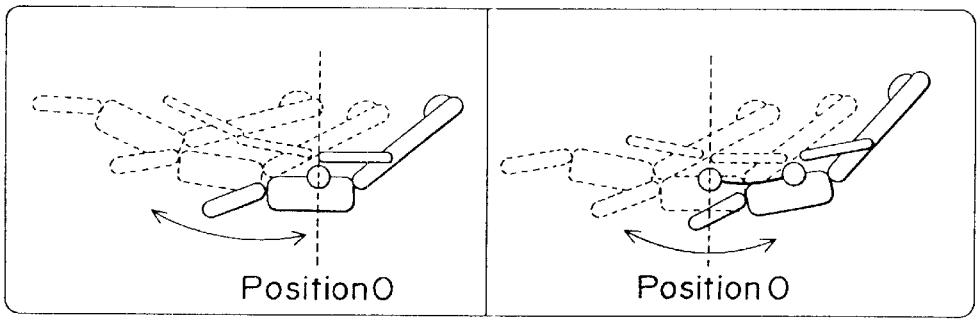
Fig.39
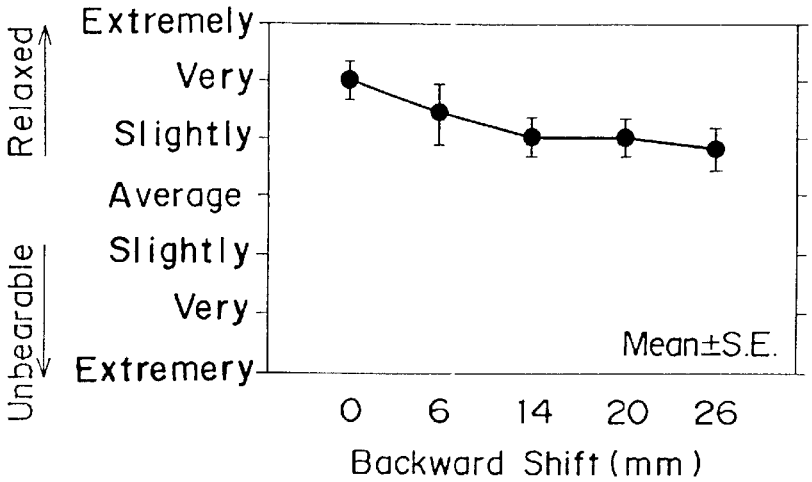

RELAXATION APPARATUS

CROSS-REFERENCE TO THE RELATED APPLICATION

This application is a continuation-in-part application of U.S. patent application Ser. No. 08/943,808, filed Oct. 3, 1997, the contents of which are herein incorporated by reference in its entirety.

FIELD OF THE INVENTION

The present invention relates to a relaxation apparatus and a method for providing relaxation and recreation for a person by applying a vibratory stimulus to the person.

DESCRIPTION OF THE PRIOR ART

It has long been well known that as a cradle or a rocking chair makes it clear, a person can feel relaxed when cyclically oscillated moderately. The Japanese Laid-open Patent Publication No. 4-216743, published Aug. 6, 1992, discloses a vibrating floor system comprising a flat support accommodated within a recess defined in a floor in flush with the floor and isolated from the floor. The flat support is oscillatably supported by means of a plurality of spring members and is adapted to be vibrated in two directions perpendicular to each other by means of respective vibrating mechanisms according to a predetermined pattern of vibration selectable through a control device.

It is well known that vibration applied to a local portion of a human body is sensed by acceleration sensitive receptors found on the skin. However, moderate oscillation or vibration applied to the whole body of a human being is detected mainly by cerebellum and semicircular canals. Accordingly, by oscillating or vibrating the whole body of the person moderately, it is rather feasible to lead the person to relaxation. Since the flat support disclosed in the above mentioned publication is used to support thereon the whole body of the person who desires relaxation, it appears that the vibrating floor system is satisfactory. However, it has been found that mere application of the vibration to the body of a human being does not necessarily lead to relaxation and will often provide an uncomfortable sensation to the person.

U.S. Pat. No. 3,532,089 issued Oct. 6, 1970 to Arntzenius discloses a bed or table supporting the body of a patient for reciprocation generally along the vertical or long dimension of the heart of the patient synchronously with the heartbeat that is sensed by a heartbeat sensor. With this bed or table, the patient's body is described accelerated rhythmically and synchronously with heartbeat, with varying degrees of magnitude (from 0 to 3 g) and duration (0 to 100 msec) of acceleration.

According to Arntzenius' patent, the bed is reciprocated in a direction generally along the vertical or long dimension of the heart of the patient, which corresponds to the lengthwise direction of the bed as viewed with the patient lying on the bed. While Arntzenius is silent as to the specific frequency of vibration of the bed, it describes that the patient's body on the bed is accelerated rhythmically and synchronously with the heartbeat, with varying degrees of magnitude from 0 to 3G and duration of 0 to 100 msec of acceleration. Assuming that the heartbeat is 65 per minute, the frequency of vibration synchronized with the heartbeat may correspond to about 1.8 Hz. However, Arntzenius' patent is directed to the bed for aiding cardiovascular circulation and is in no way related to the relaxation apparatus.

U.S. Pat. No. 4,133,305 issued Jan. 9, 1979 to Steuer discloses a relaxation apparatus including a mattress consisting essentially of an inflatable hollow body defining an interior space and having an upper reclining surface area for carrying a human body. According to this patent, an air pump is connected to the hollow body for inflating it with air. A vibrating device cooperates with the pump for periodically varying the pressure in the interior space at a preselected frequency so as to raise and lower the reclining surface area periodically. The vibrating device includes a control system for varying the preselected frequency within a range containing the respiration rates. The control system may include means for varying the amplitude of the periodic pressure variations.

U.S. Pat. No. 3,826,250 issued Jul. 12, 1972 to Adams discloses a relaxation apparatus comprising an upholstered seat accommodated within a housing for permitting a person to recline on the seat, a pair of rockers supporting the housing and adapted to be driven by a drive unit for driving the rockers to rock the housing, a vibrator connected to the seat for vibrating a person on the seat, and one or a plurality of sensory stimulators. The sensory stimulators useable in this relaxation apparatus are described including loudspeakers or earphones for providing aural stimuli, one or more displays for providing visual stimuli, food materials for providing gustatory stimuli, a scent generator for providing olfactory stimuli, and so on.

U.S. Pat. No. 4,586,492 issued May 6, 1986 to Manahan discloses a therapeutic bed comprising upper, intermediate and lower frame structures all drivingly coupled with each other. Specifically, the upper frame structure is pivotable about its central longitudinal axis with respect to the intermediate frame structure which is also pivotable about its central longitudinal axis with respect to the lower frame structure. Independent mechanical means having variable speed controls each employ a rotating eccentric arm which oscillates the respective pivotable frame structure so that the bed itself can oscillate in a circular rhythmic fashion, most nearly analogized to a boat at anchor rolling in a gentle sea.

A bed similar to that disclosed in U.S. Pat. No. 4,586,492, but movable in a circular or rotary path only in a vertical plane is disclosed in U.S. Pat. No. 5,301,661 issued Apr. 12, 1994 to Lloyd.

U.S. Pat. No. 2,570,676 issued Oct. 9, 1951 to Henderson discloses a reciprocating bed comprising a bed support capable of being oscillated in a direction perpendicular to the longitudinal sense of a human body lying on a mattress which is mounted on the bed support through a plurality of coiled springs. This patent describes that best results would be brought about when the bed support is reciprocated in length (i.e., vibrating amplitude) from ⅛ to 18 inches (about 3 to 460 mm) and/or at a rate of 24 to 800 strokes per minute (corresponding to a vibration frequency of about 0.4 to 13 Hz).

Avestibular motion table disclosed in U.S. Pat. No. 5,520,614 issued May 28, 1996 to McNamara et al. is generally similar to the bed disclosed in Henderson's U.S. Patent Number discussed above. This patent describes that best results would be brought about when he vestibular motion table is cyclically in a direction longitudinally thereof about ½ inch in each cycle (corresponding to a vibrating amplitude of about 13 mm) and/or at a frequency of 0 to 200 cycles per minute (corresponding to 0 to 3.3 Hz).

SUMMARY OF THE INVENTION

The present invention has been devised to provide an improved relaxation apparatus effective to positively bring the person into a state of relaxation.

To this end, in accordance with a broad aspect of the present invention, a relaxation apparatus which includes a support means for supporting a whole body of a person who desire relaxation. The support means is employed in the form of a reclining chair having a seat, a seatback tiltable relative to the seat, and a footrest tiltable to the seat. A vibrating means is employed to vibrate the support means to vibrate the whole body of the person at a frequency not higher than 25 Hz. A control means controls the vibrating means such that the maximum acceleration of the vibration produced by the vibrating means to vibrate the person supported on the support means is not greater than 0.1 G. Specifically, the control controls the acceleration in dependence on the frequency of vibrations outputted by the vibrating means such that said acceleration is small when the frequency of vibrations outputted by the vibrating means is low while the acceleration is large when the frequency of vibrations is high.

Preferably, the vibrating means has a capability of vibrating the support means selectively in at least first and second planes perpendicular to each other; and wherein the vibration applied from the vibrating means to the support means and then to the body of the person is such that a portion of the body of the person adjacent the waist will not be excessively pulled rearwards with respect to a position at which the vibrating means is started.

The support means may be supported by a base. In this case, to enable the person resting on the support means to be quickly led to relaxation, the vibration applied from the vibrating means to the support means and then to the body of the person is preferably of a kind that the head of the person being vibrated can move while depicting a straight path or a downwardly curved path, and/or a portion of the body of the person adjacent the waist will not be pulled rearwards more than a prescribed level.

Preferably, the vibration produced by the vibrating means acts directly on the whole body of the person and wherein said support means is movable in a direction conforming to a direction of propagation of vibrations transmitted by the vibrating means to the person.

The relaxation apparatus may further include a relaxation sensor for detecting the degree of relaxation enjoyed by the person with its output used to vary a pattern of the vibration produced by the vibrating means, and/or at least one additional vibrating means for vibrating a local portion of the body of the person, and/or at least one of a heating means for heating the body of the person, a cooling means for cooling the body of the person, at least one auxiliary stimulus means for applying an auxiliary stimulus to the person in synchronism with the vibration, and a massaging means for massaging a local portion of the body of the person.

Preferably, one or both of the frequency and the acceleration are variable according to a pattern of vibration applied to the person.

The vibrating means utilizable in the practice of the present invention may be of a type capable of cyclically vibrating the support means in a single plane, or may be of a type capable of cyclically vibrating the support means in two plans perpendicular to each other. In the latter case, the acceleration represents a rotational acceleration having vector components acting in respective directions perpendicular to each other and the maximum value of which is preferably the maximum rotational acceleration.

The reclining chair forming the support means comprises a seat, a seatback tiltable relative to the seat at an angle of about 90° to about 180° and a footrest tiltable relative to the seat at an angle of about 90° to about 180°. As a matter of course, when the seatback and the footrest are set at respective 180° positions relative to the seat, the reclining chair as a whole represents a configuration similar to a bed. Preferably, the reclining chair may be of an electrically powered reclining chair in which one or both of the seatback and the foot rests are electrically powered to tilt.

In another preferred embodiment of the present invention, the relaxation apparatus may further comprises an additional vibrating device such as, for example, at least one massaging device for massaging a localized area of the body of the person desiring relaxation. In addition to or separate therefrom, a cooling means and/or a heating means may be employed together with or separate from an auxiliary stimulating means for applying an auxiliary stimuli to the body of the person synchronously with the vibration applied thereto.

If the upper limit of the absolute value of the acceleration exceeds 0.1 G, most of the people will feel uncomfortable and/or unbearable. By way of example, FIG. 5 illustrates how people being vibrated entirely at a varying frequency would feel with change in effective value of the vibratory acceleration. The graph of FIG. 5 is reproduced from a book entitled "Ningen-Kogaku Gairon (Introduction to Human Engineering)" published from Asakura Shoten. In this graph, a curved band A represents the region of vibrations the average people can bear; a curved band B represents the region of vibrations the average people feel uncomfortable; and a curved band C represents a region of threshold of the vibratory stimulus.

The effective value of the acceleration may be about 0.0001 G. This value of 0.0001 G is far smaller than that shown in the graph of FIG. 5. However, according to the graph of FIG. 6 in which an objective evaluation (i.e., 95% reliable region of the acceleration felt comfortable by people) is shown as a result of investigation carried out by the inventors, the vibration at an acceleration in the order of $10^{-4}$ G could be felt comfortable so long as the vibration is of a relatively low frequency, especially not higher than 1 Hz. Although the vibration is barely felt by persons if the acceleration is smaller than 0.0001 G, some people may be brought into a relieved state depending on the vibratory frequency even though no vibration is sensed.

According to the present invention, the vibrating means is preferably capable of vibrating the support means at a frequency corresponding to the eigen (proper) vibration of a railway car that is lower than 25 Hz, with an acceleration of a magnitude corresponding to 1.5 or less of the coefficient of railway riding comfort. As discussed in "Shindou Kougaku Handobukku (Handbook of Vibration Engineering)", pp 1144–1146, published 1991 from Kabushiki Kaisha Yokendo of Japan, the proper vibration of the railway car that is lower than 25 Hz is made up of a low frequency vibration (not higher than 2 Hz) and a high frequency vibration (7 to 13 Hz) both acting in a horizontal direction perpendicular to the length of the railway car and a low frequency vibration (1 to 3 Hz) and a high frequency vibration (8 to 13 Hz) both acting in a vertical direction perpendicular to the length of the railway car.

Also, according to the handbook, supra, the proper vibration of an ordinary railway bogie car includes a linear vibration represented by cyclic movement in a direction conforming to the length of the bogie car, a vertical vibration represented by cyclic movement in a vertical direction perpendicular to the length of the bogie car, a horizontal vibration represented by cyclic movement in a horizontal direction perpendicular to the length of the bogie car, and rotatory vibrations such as rolling, yawing and pitching. The proper value of the linear vibration is considered to be within the range of 1.5 to 2.5 Hz, that of the vertical vibration is considered to be within the range of 1 to 3 Hz and that of the horizontal vibration is considered to be not higher than 2.0 Hz. Other than those vibrations, the bogie car exhibits a flexing vibration of 8 to 13 Hz commonly in those directions, and in all cases, the newer the railway car, the lower the frequency of vibration.

Relationships between the railway riding comfort and the vibrating characteristics of the railway car acting in respective directions are shown in FIGS. 36A to 36C. Referring to these figures, at a low frequency region not higher than 3 Hz that can be perceived by the sense of proportion, the linear vibration acting in a direction conforming to the length of the railway car is of such a low level as compared with that acting in any other direction that the linear vibration will not almost affects the riding comfort. However, 5 to 10 Hz region of the linear vibration is associated with the riding comfort and it has been found that the lower the level of this vibration, the higher the riding comport. Also, if the frequency of vibration of the railway car exceeds 25 Hz, passengers on the railway car will feel uncomfortable even though the acceleration is low and will therefore find difficulty relaxing.

In view of the foregoing, in the practice of the present invention, the support means is vibrated at a frequency which is not higher than 25 Hz in the horizontal (leftwards and rightwards) direction perpendicular to the longitudinal sense of the body of the person desiring relaxation and which, as far as the vertical (up and down) direction is concerned, corresponds to the level of acceleration corresponding to 1.5 or less of the riding comfort of the railway car. As a result thereof, the person can be led to relaxation without feeling any discomfort which would be brought about by velocity and vibration.

By the reasons discussed hereinabove, the vibrating means is so designed as to apply the vibration of a frequency not higher than 25 Hz. However, considering that people have their own personal preference, the frequency of vibration applied from the vibrating means to the support means is preferably not higher than 12 Hz.

In order to render the relaxation apparatus to accommodate preference of the user which may vary from person to person, the vibratory frequency and/or the effective acceleration may preferably be adjustable. Change in vibratory frequency and/or effective acceleration may be automatically accomplished either according to the length of time passed, a 1/f fluctuation pattern or the number of cycles of vibration. Alternatively, it may be accomplished manually by the user. In particular, where one or both of the vibratory frequency and the effective acceleration are desired to be changed or adjusted according to the length of time passed or the number of times of application of the vibration (i.e., the number of times of use of the apparatus), this can be accomplished by the use of a timer or a number-of-use presetting device. Where one or both of the vibratory frequency and the effective acceleration is desired to be changed or adjusted according to the 1/f fuzzy scheme, it can be implemented by the use of a computer executable software that causes the vibrating means to produce a pattern of 1/f fuzzy vibration. Again, design may be made that one or both of the vibratory frequency and the effective acceleration can be gradually reduced according to the length of time passed or the number of times of application of the vibration, so that the person on the support means can be smoothly led to relaxation.

To apply vibration to the body of the person on the support means involves the body of the person being cyclically shifted forwards and backwards. Accordingly, a zero-velocity condition will occur for a considerably slight length of time at the time of reversal of one of the forward shift and the backward shift to the other. The shorter the duration of the zero-velocity condition, the better. By way of example, if the duration of the zero-velocity condition will be about 500 msec, it is not proper since the person will feel discontinuity of the cyclic movement.

Also, the use may also be made of a relaxation sensor for detecting the degree of relaxation enjoyed by the person, an output from said relaxation sensor being used to vary the pattern of vibration produced by the vibrating means. Specifically, depending on the degree of relaxation detected by the relaxation sensor, the vibrating means may be brought to a halt or may be set in a predetermined vibrating mode and/or an awaking stimulus may be applied to the person being oscillated. This is particularly advantageous where the user resting on the support means begins to sleep.

The use of the relaxation sensor may not be essential in the practice of the present invention, in which case the relaxation apparatus may be so designed that upon passage of a predetermined length of time of use of the apparatus or increase of the number of times of use of the apparatus over a predetermined value, the vibrating means can be brought to a halt or be operated under a predetermined vibrating mode, and/or an awaking stimulus can be applied to the person being relaxed.

The relaxation apparatus of the present invention may also comprise one or all of a heating means for heating the body of the person, a cooling means for cooling the body of the person, an auxiliary stimulus means for applying an auxiliary stimulus to the person in synchronism with the vibration, and a massaging means for massaging a local portion of the body of the person.

Preferably, regardless of the use of the heating means, the cooling means and the auxiliary stimulus means, the reclining chair employed for the support means is preferably in the form of an electrically powered reclining chair having the seatback and the foot rest that can be electrically driven to assume a horizontal position generally in flush with the seat to render the reclining chair to assume a substantially full flat position. Setting the reclining chair in the full flat position may be made in response to the degree of relaxation sensed by the relaxation sensor, passage of the predetermined length of time of use of the apparatus and/or increase of the number of times of use over the predetermined value. This feature is particularly advantageous in that the seat occupant being relaxed can readily feel at easy with increase of the degree of relaxation.

The present invention also provides a method of relieving a person desiring relaxation. This method comprises the steps of preparing a support means for supporting thereon a whole body of the person; vibrating the support means to vibrate the whole body of the person; and controlling the vibrating means to generate vibrations of a frequency not higher than 25 Hz with the maximum absolute value of acceleration of the vibration being not greater than 0.1 G.

In the practice of the present invention, the vibration produced by the vibrating means may be applied to the body of the person in any desired manner and in any desired mode. By way of example, where the support means comprises a reclining chair of the type referred to hereinbefore, i.e., that having a tiltable seat back and a tiltable footrest, the reclining chair as a whole may be vibrated in one or a combination of any desired directions including an x-axis direction conforming to the longitudinal sense of the body of the person, a y-axis direction perpendicular to the longitudinal sense of the body of the person and also to the x-axis direction, a z-axis direction perpendicular to any of the x-axis and y-axis directions and a combination thereof.

On the other hand, where the support means comprises the reclining chair of a type that is suspended by a stand for cyclic rocking motion in a direction conforming to the longitudinal sense of the body of the person, the vibrating means may be of a type capable of cyclically pushing the reclining chair from rear of the tiltable seatback.

In any event, in accordance with the present invention, it is essential that the frequency of vibrations applied to the body of the person occupying the support means should not exceed 25 Hz with the acceleration not greater than 0.1 G and variable in dependence on the frequency of vibrations. Specifically, the acceleration may be small or large when the frequency of vibrations is low or high, respectively. Thus, in the present invention, the frequency of vibrations and the acceleration are correlated with each other.

BRIEF DESCRIPTION OF THE DRAWINGS

The present invention will become readily understood from the following description of preferred embodiments thereof made with reference to the accompanying drawings, in which like parts are designated by like reference numeral and in which:

FIG. 37 is a graph showing the relationship between the frequency of vibration and the effective acceleration that can be acceptable in the practice of the present invention;

FIGS. 38A and 38B are explanatory diagrams showing the manner in which the reclining chair is vibrated fore and after during a series of experiments conducted for the purpose of the present invention; and FIG. 39 is a graph showing how a seat occupant during the experimentation felt when he was vibrated with or without his waist pulled backwards.

DETAILED DESCRIPTION OF THE EMBODIMENTS

Figure 1:
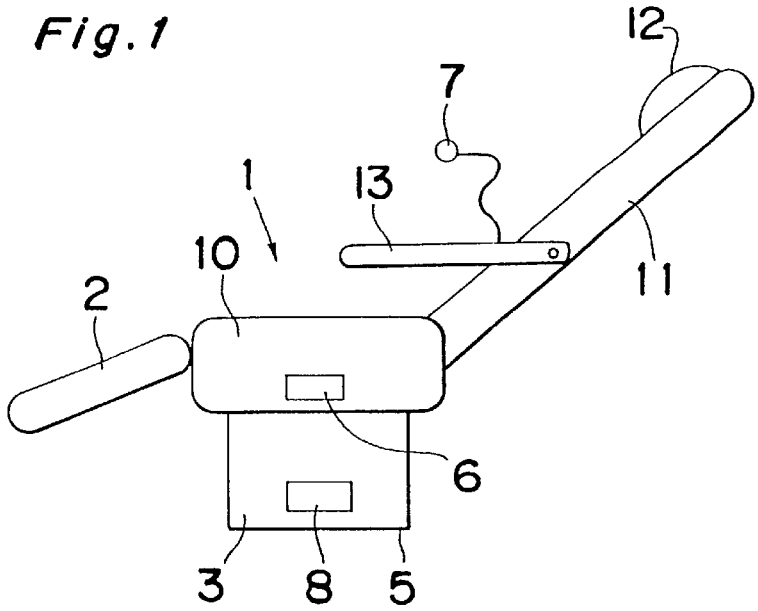
FIG. 1 is a schematic side view of a reclining chair embodying the present invention.
Figure 2A:
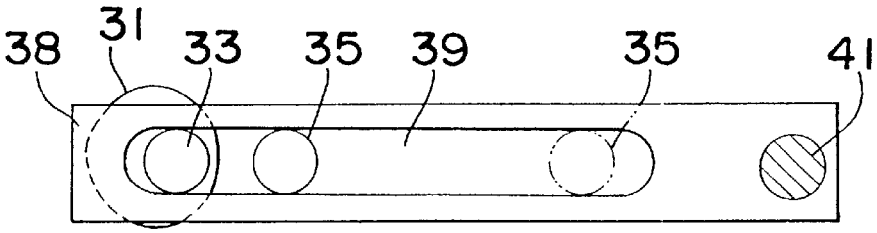
FIG. 2A is a top plan view of a movable arm forming a part of a vibration generating mechanism of a vibrating device employed in the reclining chair.
Figure 2B:
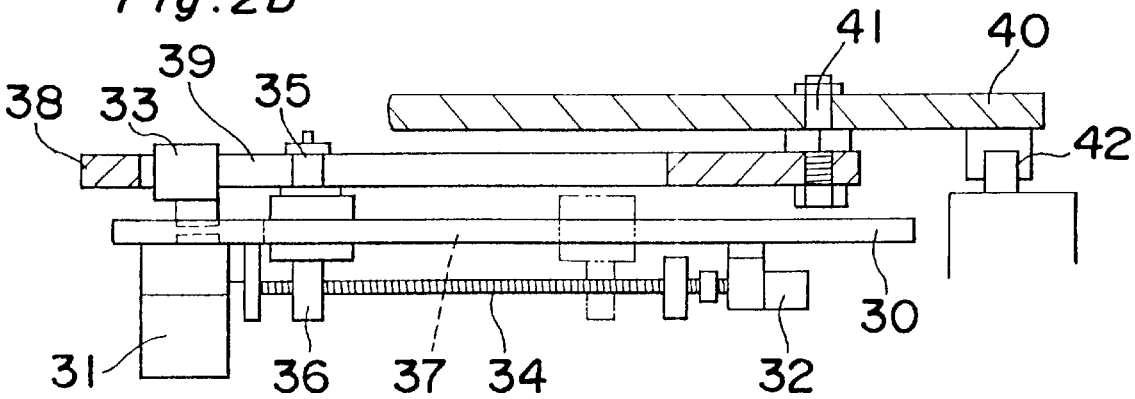
FIG. 2B is a fragmentary sectional view of the vibration generating mechanism.

The relaxation apparatus according to the present invention generally comprises a support means for supporting a person desiring relaxation in his or her entirety, a vibrating device for providing a vibratory stimulus to the person through the support means and a control means for controlling the vibrating device. FIG. 1 illustrates the support means in the form of a reclining chair 1. The reclining chair 1 shown therein comprises a box base 5 accommodating therein a control device 8, a seat 10 mounted atop the box base 5, a reclining back 11 tiltable relative to the seat 10 and having a headrest 12 and also having a pair of armrests 13, a footrest 2 positioned on one side of the seat 10 opposite to the reclining back 11 and tiltable relative to the seat 10.

The vibrating device, identified by 3, is housed within the box base 5 together with the control device 8 operable to control the operation of the vibrating device 3. This vibrating device 3 is so designed and so configured as to vibrate the reclining chair 1 in its entirety including not only the reclining back 11, but also the footrest 2 during activation of the vibrating device 3. Accordingly, when a person desiring relaxation is seated on the reclining chair 1 with his back resting on the reclining back 11 and with his feet resting on the footrest 2, the seat occupant of the reclining chair 1 can be vibrated in his or her entirety.

The vibrating device 3 is of a type capable of providing the reclining chair 1 with vibrations of a frequency not higher than 25 Hz and/or at an effective acceleration, the uppermost limit of the absolute value of which is not greater than 0.1 G While the direction of propagation of the vibration produced by the vibrating device 3 and a specific mechanism for generating the vibration are immaterial to the present invention so far as the vibrating device satisfies the frequency and/or acceleration requirements discussed above, the vibrating device 3 that can be advantageously employed in the practice of the present invention is shown in FIGS. 2A, 2B, 3A and 3B.

Referring now to FIGS. 2A, 2B, 3A and 3B, the vibrating device 3 comprises a vibration generating mechanism including a generally elongated base 30 has an axial slot 37 defined therein and also having first and second drive motors 31 and 32 secured thereto. The first drive motor 31 has an eccentric cam 33 mounted on an output shaft thereof for rotation together therewith, and the second drive motor 32 has a screw shaft 34 coupled with an output shaft thereof for rotation together therewith. A slider 36 having a pivot pin 35 formed integrally therewith is threadingly mounted on the screw shaft 34 so that during rotation of the screw shaft 34, the slider 36 can move axially along the screw shaft 34.

Positioned immediately above the base 30 is a movable arm 38 having an axial slot 39 defined therein. The eccentric cam 33 and the pivot pin 35 integral with the slider 36 are, after having been passed through the axial slot 37 in the base 30, situated within the axial slot 39 in the movable arm 38, and while the position of the pivot pin 35 within the axial slots 37 and 39 varies as the slider 36 is moved along the screw shaft 34 then driven by the second drive motor 32, the eccentric cam 33 is positioned adjacent one of opposite ends of the axial slot 39. Accordingly, when the first drive motor 31 is driven to rotate the eccentric cam 33, the movable arm 38 undergoes a rocking motion about the pivot pin 35.

Figure 3A:
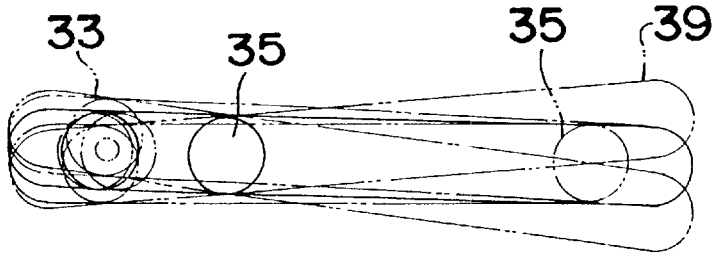
FIGS. 3A and 3B are top plan and side views of the movable arm, respectively, showing how the movable arm is angularly moved.
Figure 3B:
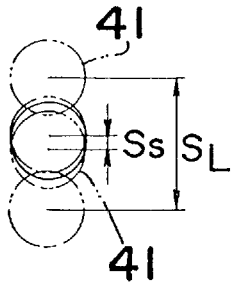

Since as hereinabove described the pivot pin 35 is movable within and along the axial slot 39 in the movable arm 38, the angle of swing of one end of the movable arm 38 remote from the eccentric cam 33 about the pivot pin 35 is relatively large as shown by $S_L$ when the pivot pin 35 is positioned distant from the eccentric cam 33, but is relatively small as shown by $S_S$ when it is positioned adjacent to the eccentric cam 33 and adjacent the other end of the axial slot 39, as shown in FIG. 3B.

Accordingly, a generally elongated oscillating base 40 connected at a generally intermediate portion thereof with such one end of the movable arm 38 by means of a connecting pin 41 and also slidably connected at one end thereof with a slide guide 42 is repeatedly shaken in a direction perpendicular to the lengthwise direction thereof when the first drive motor 31 is driven. The stroke over which the oscillating base 40 is repeatedly shaken or oscillated depends on the position of the pivot pin 35 within the axial slot 39 in the movable arm 38. Thus, it will readily be understood that by varying the number of revolution of the first drive motor 31, the frequency of lateral oscillation of the oscillating base 40 can be varied. Hence, the acceleration of oscillation can be determined depending on the stroke of oscillation of the oscillating base 40 which varies depending on the position of the pivot pin 35 within the axial slot 39 in the movable arm 38, and the frequency of oscillation of the oscillating base 40. More specifically, the effective acceleration G can be calculated by the following equation:

$$G=\{(2\pi f)^2\times A\}/(2\times 1000\times 9.8\times 2^{1/2})$$

wherein A represents the amplitude (mm) and f represents the frequency (Hz).

Figure 4:
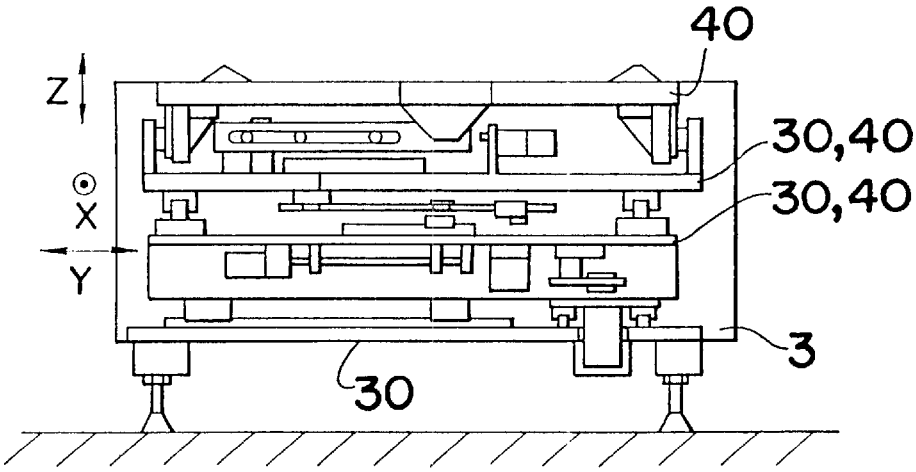
FIG. 4 is a schematic sectional view of the vibrating device employing a plurality of the vibration generating mechanisms.
Figure 5:
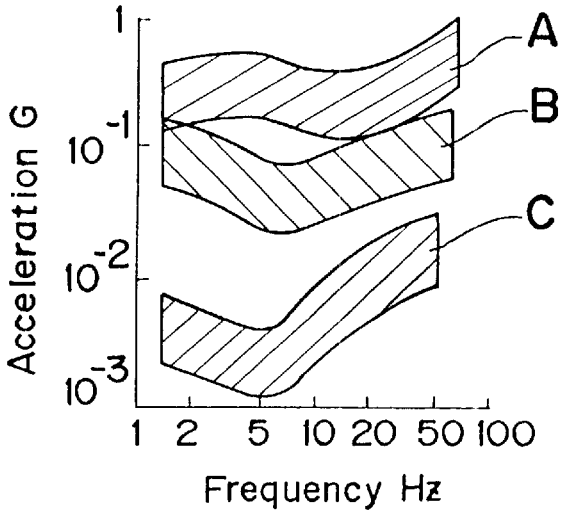
FIG. 5 is a graph showing how vibrations are objectively evaluated for a particular frequency and acceleration.
Figure 6:
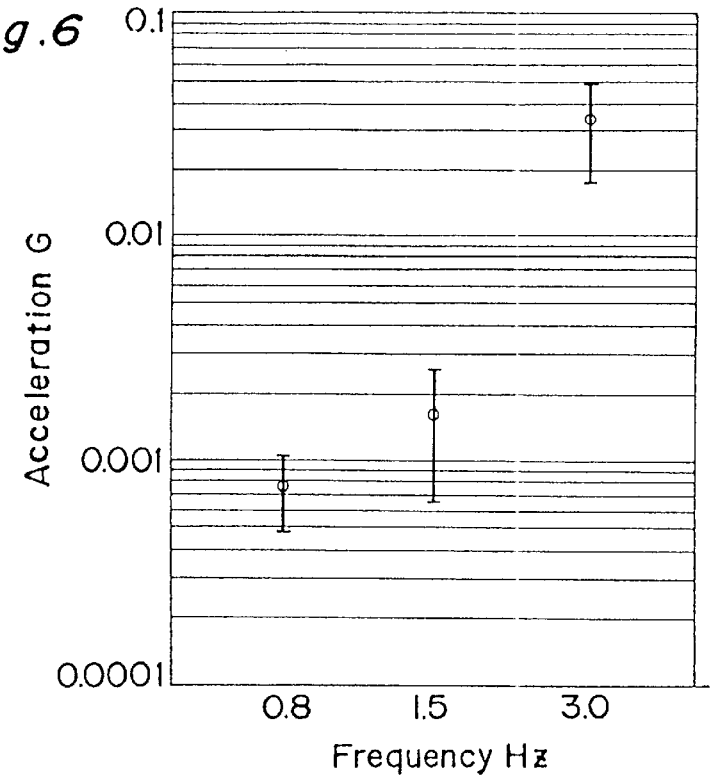
FIG. 6 is an explanatory diagram showing an objective evaluation of the acceleration at a low frequency region.

The use of the single vibration generating mechanism of the structure shown in FIGS. 2A to 3B appears to be sufficient where the reclining chair 1 is desired to be vibrated only in one direction, for example, forwards and rearwards, laterally or up and down with respect to the seat occupant. However, in the practice of the present invention, the vibrating device 3 referred to hereinbefore makes use of three identical vibration generating mechanisms as shown in FIG. 4. These vibration generating mechanisms are stacked one above the other, but drivingly coupled with each other so as to produce three oscillatory motions acting in X, Y and Z directions substantially perpendicular to each other. With the reclining chair 1 resting on the oscillating base 40 of the final stage, i.e., the topmost one of those vibration generating mechanisms, it will readily understood that the oscillatory motions can be transmitted to the reclining chair 1 including the footrest 2 through the final-stage oscillating base 40.

The three vibration generating mechanisms need not always be activated simultaneously, one or two of them may be activated if the reclining chair 1 is desired to be vibrated in one direction or two directions, respectively. Also, the mode of vibration or oscillation subjected to the seat occupant may be translational or linear, rotational or a combination thereof. By way of example, in the illustrated embodiment, the X direction is assumed to be the direction in which the reclining chair 1 is oscillated fore and aft; the Y direction is assumed to be the direction in which the reclining chair 1 is oscillated sideways; and the Z direction is assumed to be the direction in which the reclining chair 1 is vibrated up and down. Accordingly, if two of the vibration generating mechanisms which are effective to produce the oscillatory motions in the X and Z directions, respectively, are activated simultaneously, the reclining chair 1 undergoes a cyclic quasi-swinging motion following a generally circular path with the seat 10 kept substantially horizontal.

Figure 7A:
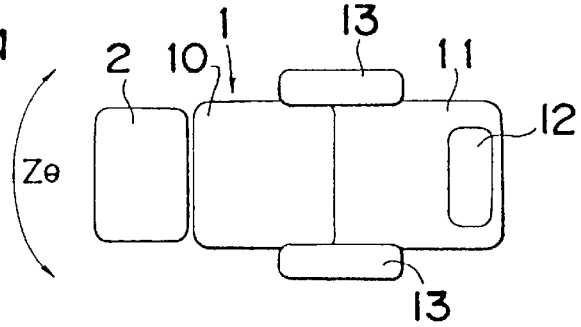
FIGS. 7A to 7C are schematic top, front and side views of the reclining chair, showing respective directions of vibration of the reclining chair.
Figure 7B:
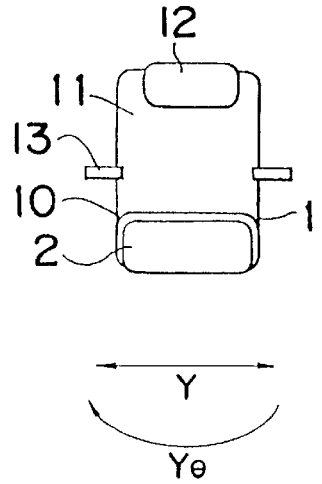
Figure 7C:
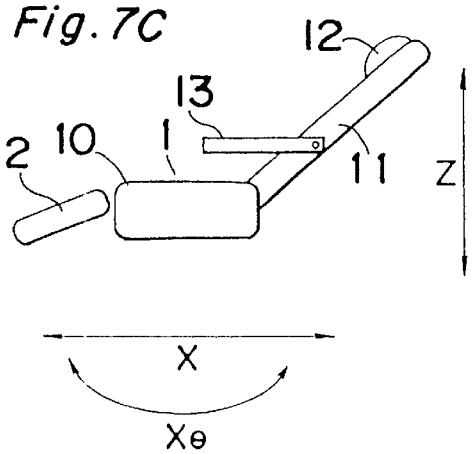

In addition to the three oscillatory motions in the X, Y and Z directions, respectively, the reclining chair may be so designed as to accomplish three cyclic rotatory motions about associated axes, i.e., a yawing vibration Zθ, a rolling vibration Yθ and a pitching vibration Xθ, as shown in FIGS. 7A to 7C, respectively.

Where the pitching vibration Xθ, the rolling vibration Yθ and the yawing vibration Zθ are to be imparted to the seat occupant through the reclining chair which forms the support means, the uppermost limit of the absolute value of the acceleration in each of the X, Y and Z directions has to be chosen not greater than 0.1 G.

Since the direction of vibration with which the seat occupant of the reclining chair can feel comfortable varies from person to person, it is preferable to provide the seat occupant with an option to select the direction of vibration. Also, where the plural directions of vibration are to be combined, the frequency of vibration in each direction and the acceleration may be differentiated for each direction. By way of example, the relationship between the mode of vibration and the direction of propagation of the vibration or the frequency of vibration may be such that where the mode of vibration is translational or linear, the direction of propagating of the vibration may preferably conform to the direction Y or the direction Z, in which case the frequency of vibration is to be within the range of about 0.4 to about 4.0 Hz in the direction Y or within the range of about 1.0 to about 12.0 Hz in the direction Z, respectively. In the case where the mode of vibration is rotational, the pitching vibration Xθ in which the seat occupant can be oscillated in the fore and aft direction X is preferred, in which case the frequency of vibration is to be within the range of about 0.1 to about 1.0 Hz. The frequency of sideways vibration in the direction Y is preferably within the range of 0.4 to 4.0 Hz, and the frequency of up and down vibration in the direction Z is preferably within the range of 1.0 to 12.0 Hz.

Figure 8A:
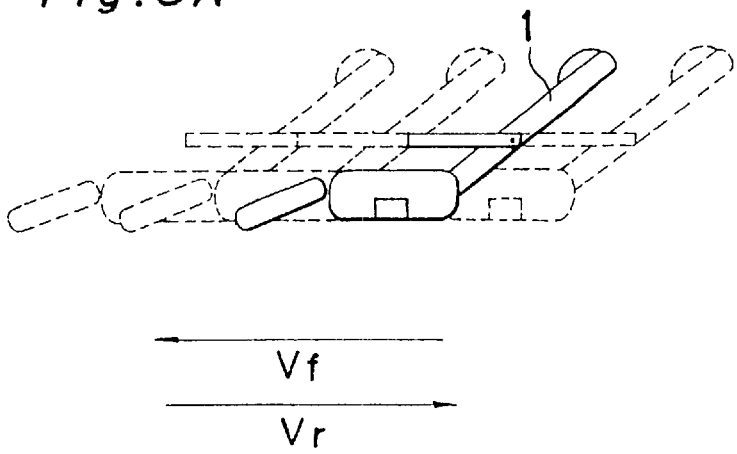
FIG. 8A is a schematic side view used to explain the direction of vibration of the vibration and the velocity of movement of the reclining chair.
Figure 8B:
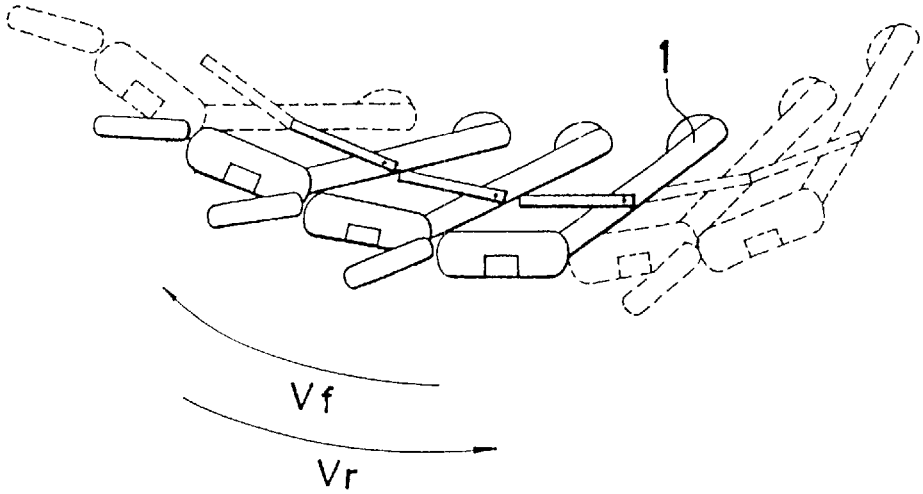
FIG. 8B is a schematic side view used to explain the different direction of vibration of the vibration and the different velocity of movement of the reclining chair.

Each of the velocity and acceleration of one of opposite motions during the vibration may be equal to or may not be equal to that in the other of the opposite motions. Particularly where the vibration consists of a cycle of motions in the fore and aft direction X as shown in FIG. 8A or the vibration results in a cyclic pitching vibration Xθ as shown in FIG. 8B, it has been found that selection of the velocity Vr of the rearward motion to be lower than the velocity Vf of the forward motion often brings about a favorable result.

Alternatively, instead of the use of the different velocities Vf and Vr, different strokes of movement may be equally employed. By way of example, the stroke of movement of the reclining chair 1 during the forward motion may be chosen to be twice that during the rearward motion, and the forward motion and the rearward motion are reversed each time a predetermined length of time has passed. According to this alternative embodiment, it is possible for the seat occupant to feel as if there were a small rocking motion in a large rocking motion and, accordingly, the possibility can advantageously be eliminated that the seat occupant may feel bored. Also, this alternative embodiment makes it possible to change the reference angle of the body of the seat occupant with reciprocation of the forward and rearward motions, and therefore, the seat occupant can be led to a comfortable feeling while being relaxed. In particular, where the different numbers of cyclic rocking motions and the different accelerations are employed for each of the forward and rearward motions, a complicated rocking pattern can be attained.

In a further preferred embodiment of the present invention, the length of time required to complete the forward motion of the reclining chair 1 may be chosen to be shorter than that required to complete the return, rearward motion. As is well known to those skilled in the art, if a person gets relaxed, application of a stimulus to adjust the breathing so that the person can breath in synchronism with the applied stimulus is effective to facilitate relaxation on the part of such person. In such case, with increase of the degree of relaxation, the breathing cycle varies in such a way, for example, that when the person lies quietly (at an initial stage of sleeping), exhalation takes a longer time than inhalation does with the ratio of inhalation relative to exhalation (I:E) being considered within the range of 1:2 to 1:3. Also, it is generally said that during the exhalation, the heartbeat reduces and the function of the parasympathetic nervous system is accelerated as compared with those during the inhalation.

Accordingly, in the practice of the embodiment in which the length of time required to complete the forward motion of the reclining chair 1 is chosen to be shorter than that required to complete the return, rearward motion, the pitching of the reclining chair 1 is preferably synchronized with the breathing of the seat occupant desiring relaxation. For this purpose, the relaxation apparatus of the present invention may be provided with a breathing sensor that can be detachably fitted to the body of the seat occupant. An output signal from the breathing sensor may be utilized to control the length of time required for the reclining chair 1 to undergo a reciprocating pitching. Where this feedback control is employed, a rocking stimulus synchronous with the breathing cycle may be applied to the seat occupant. However, it can be contemplated that the rocking stimulus of a cycle slightly slower than the breathing cycle detected by the breathing sensor be applied to allow the breathing to be synchronized therewith. By way of example, the pitching cycle may be shorter by 1% than the breathing cycle actually detected by the breathing sensor.

Figure 9:
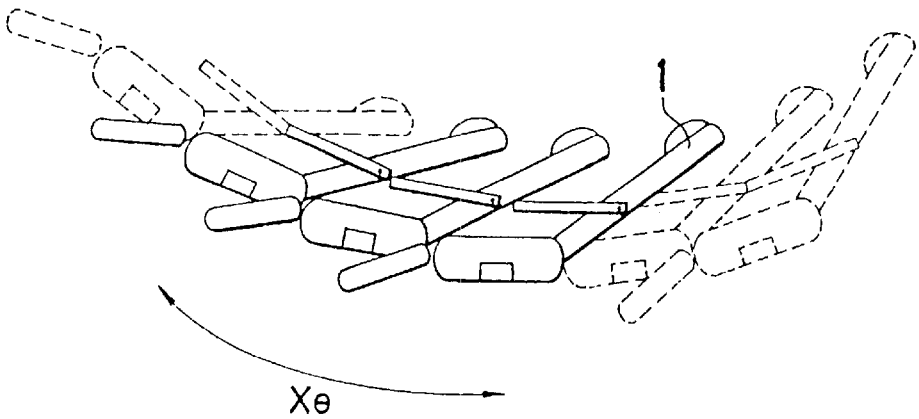
FIG. 9 is a schematic side view of the reclining chair, showing the direction of vibration and the range of movement of the reclining chair.

As far as the cyclic pitching vibration Xθ is concerned, as shown in FIG. 9, it may be effected in a region forwardly of the vertical with no oscillation taking place in a region rearwardly thereof, or the amount of motion in the rearward region may be chosen to be smaller than in the forward region. This is because if he waist of the seat occupant of the reclining chair is pulled rearwards, there is the ossibility that the seat occupant will feel as if pitched down or fallen forwards, ausing him or her to feel uneasy to relax. In this connection, reference will now be made to FIGS. 38A and 38B and FIG. 39, all of which are observed with a series of experiments conducted to determine how some healthy adult subjects felt when vibrated through the reclining chair forming a part of the relaxation apparatus of the present invention.

Referring first to FIG. 39, the axis of abscissas represents the distance over which the waist of the subject was pulled backwards. For the purpose of calculation, the position zero (0) represents the position of the center of the seat 10 when the reclining chair 1 is standstill, i.e., in an inoperative position.

During the experimentation, the subject was vibrated at a frequency of vibration of 0.25 Hz with amplitude of 46 mm for 30 sec. to 1 min. At the same time, the subject occupying the reclining chair was vibrated cyclically forwards and rearwards as shown in FIGS. 38A and 38B. Specifically, FIG. 38A illustrates the condition in which the subject was vibrated cyclically forwards and rearwards in the fore and aft direction X, starting from and terminating at the position where the waist of the subject aligned with the position zero. FIG. 38B illustrates the condition in which the subject was vibrated cyclically forwards and rearwards in the fore and aft direction X with the waist of the subject pulled a varying distance (i.e., 6, 14, 20 and 26 mm) backwards from the position zero during the rearward shift of the seat.

As the graph of FIG. 39 shows, the subject has indicated that if the cyclic vibration contained a backward shift of the waist, that is, a vibratory component backwards with respect to the position zero, the relaxing sensation decreased. Thus, if the distance of the backward shift exceeded approximately 20 mm, an average result obtained from the series of experiments is that the relaxation sensation degrades from "Acceptably Relaxed" down towards an unbearable physical condition, i.e, a tensioned, uncomfortable and/or unstable condition. The more the distance of the backward shift increases, the more the sensation of relaxation and comfort decrease.

Figure 10:
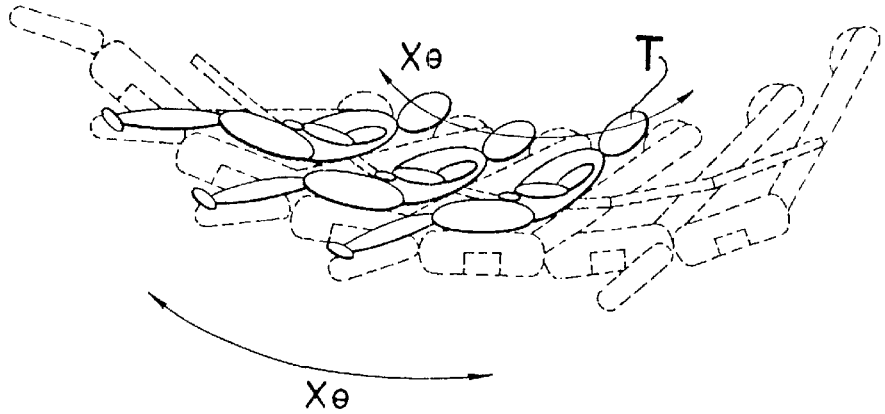
FIG. 10 is a schematic side view of the reclining chair, showing the direction of vibration and the range of movement of the reclining chair.
Figure 11:
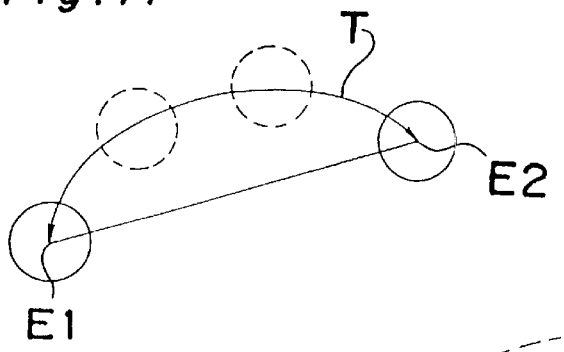
FIG. 11 is a schematic diagram used to explain the different direction of vibration and the path of vibration.
Figure 12:
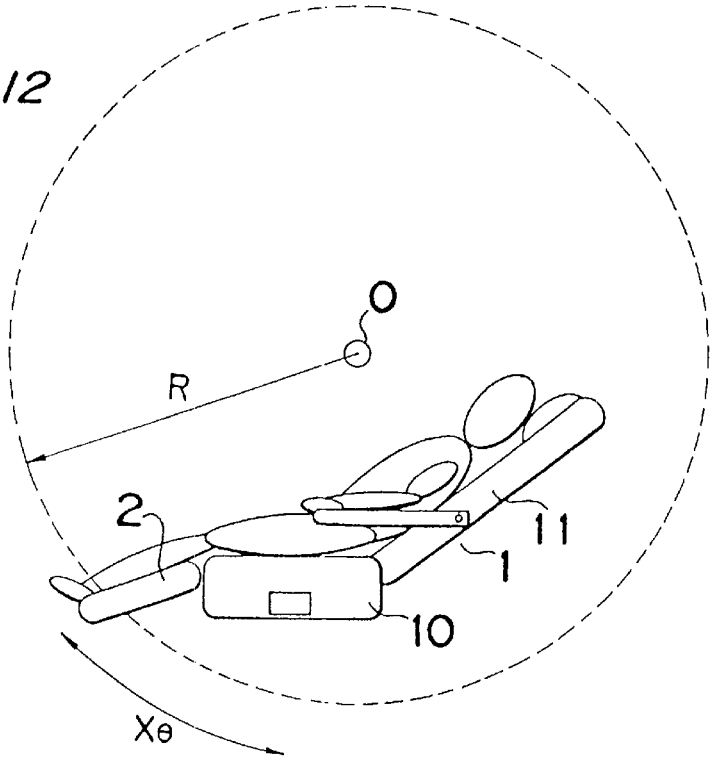
FIG. 12 is a schematic side view used to illustrate the center of pitching vibration.

In addition, in the case of the cyclic pitching vibration Xθ, the cyclic pitching vibration is preferably so carried out that while the center of the imaginary circle, a part of which is occupied by the cyclic pitching vibration, is positioned above the head of the occupant, the head of the seat occupant being oscillated can depict a trajectory T that is downwardly curved as shown in FIG. 10. This is because, if the trajectory T depicted by the movement of the head of the seat occupant is upwardly curved with respect to the imaginary line drawn to connect between opposite ends E1 and E2 of the stroke of the pitching vibration Xθ as shown in FIG. 11, the seat occupant will have difficulty relaxing.

The center O of curvature along which cyclic motions take place during the pitching vibration Xθ is, if the support means comprises the reclining chair, positioned about 600 to 700 mm above a rear portion of the top surface of the seat 10, in which case the radius R of the curvature along which the cyclic motions take place during the pitching vibration Xθ may be about 1,000 mm. In any event, the center O of curvature along which the cyclic motions take place is positioned adjacent the head of the seat occupant resting on the reclining chair. If the distance between the center O of curvature and the head of the seat occupant on the reclining chair is so small, rocking of the occupant's head during the pitching vibration Xθ can be reduced accompanied by minimization of motion sickness the seat occupant may suffer from. If the center O of curvature referred to above is positioned immediately above the occupant's head, the rocking of the occupant's head would hardly occur and the seat occupant would hardly sense the vibration if the acceleration is low.

In either case, it is preferred that the feet of the seat occupant will not come above the level of the head of the same seat occupant, or the seat occupant will feel uncomfortable with the feet positioned above the level of the head. This is particularly true where the reclining chair 1 undergoes a pitching motion during which the feet are apt to come above the level of the head consequent upon termination of the forward stroke. One method to avoid the possibility of the feet being positioned above the level of the head when during the pitching motion the forward stroke of movement terminates is to lower the footrest 2 from the position generally in flush with the seat 10 and/or to erect the seatback 11 from the position generally in flush with the seat 10.

Figure 13:
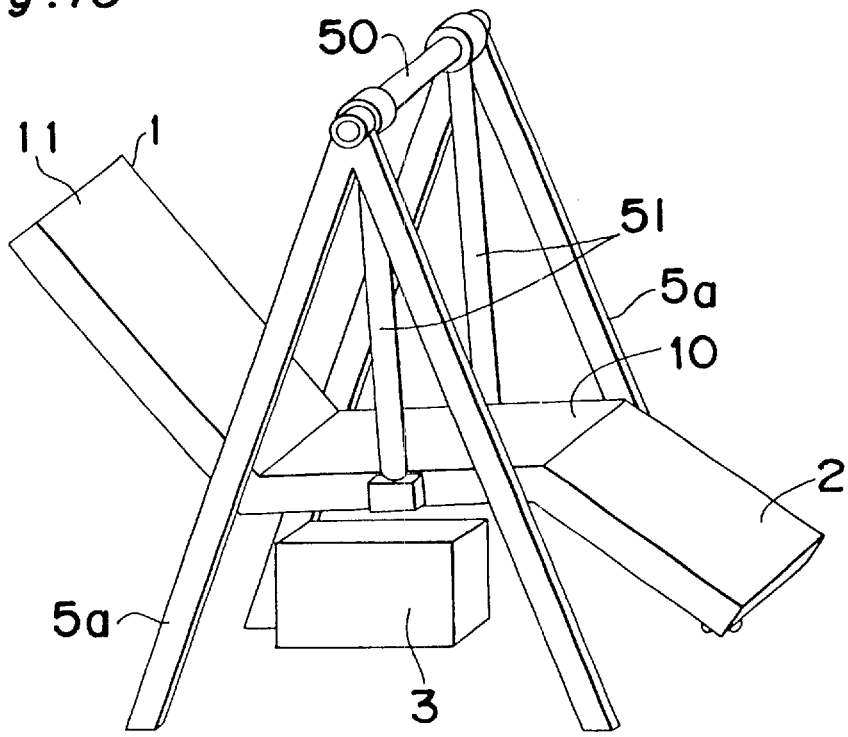
FIG. 13 is a schematic perspective view of a chair according to another embodiment of the present invention.

One preferred example of means for imparting the pitching vibration Xθ having the center O of curvature to the support means and also to the seat occupant is shown in FIG. 13. Shown in FIG. 13 is a swinging chair 1 comprising left and right legs 5*a* each being of a shape similar to the inverted figure of 'V', a transverse rod 50 connecting tops of the legs 5*a* together in spaced relation, and left and right suspending rods 51 rotatably mounted at one end on the transverse rod 50 so as to extend downwardly from the transverse rod 50. Respective lower ends of the suspending rods 51 are rigidly connected to opposite sides of the seat 10 to thereby support the chair 1 for swinging motion about the transverse rod 50. The vibrating device 3 is drivingly coupled with the chair 1 to swing the latter in a direction fore and aft so as to depict a curved path with its center of curvature occupied by the transverse rod 50.

In order for the chair 1 to be cyclically swung at a desired frequency and an effective value of acceleration, the vibrating device 3 may include a braking means or may be of a structure designed to alternately push and pull the chair 1. In other words, the vibrating device 3 employed in the illustrated embodiment is to be understood as operable not only to apply a force to the support means and the seat occupant of the support means, but also to suppress the force and the movement brought about by the support means and the occupant.

Figure 14:
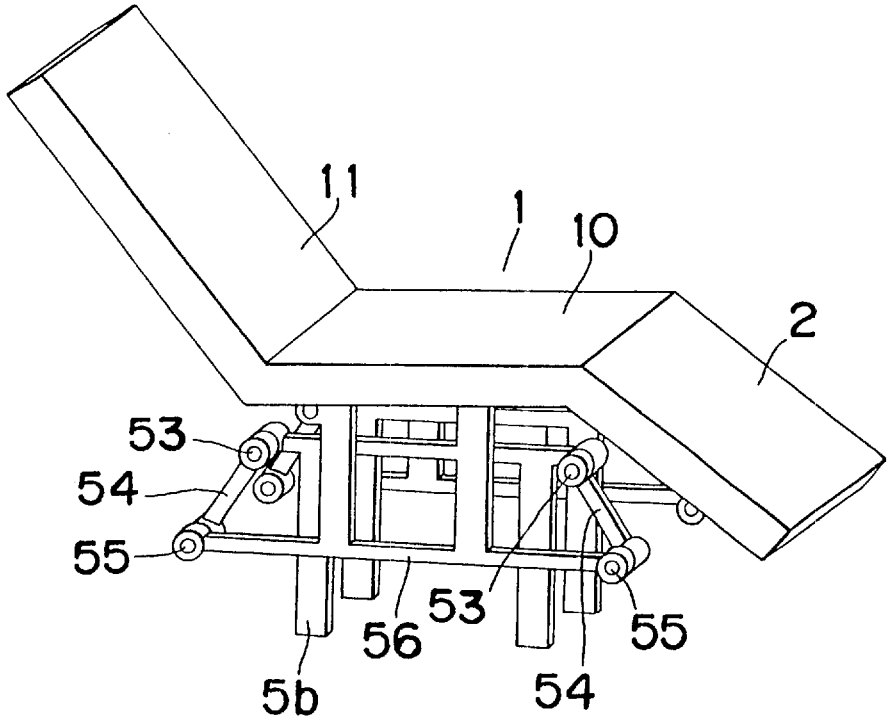
FIG. 14 is a schematic perspective view of the chair according to a different embodiment of the present invention.

An alternative support structure for the chair 1 is shown in FIG. 14, which comprises a four-legged bench on which the chair 1 is movably mounted to accomplish the pitching vibration Xθ in a manner which will now be described. The four-legged bench includes front and rear legs, generally identified by 5*b*. The seat 10 has left and right links 56 carried thereby and positioned immediately below the opposite sides of the seat 10 so as to extend generally horizontally in a direction longitudinally of the chair 1. Each link 56 has its opposite ends pivotally connected with the left or right front and rear legs 5*b* by means of front and rear connecting rods 54. Each of the connecting rods 54 on the left or right side of the seat 10 is pivotally connected at one end with top of the front or rear leg 5*b* by means of a stud shaft 53 and at the opposite end with the corresponding end of the link 56 by means of a stud shaft 55 so as to form a parallel crank mechanism.

Figure 15:
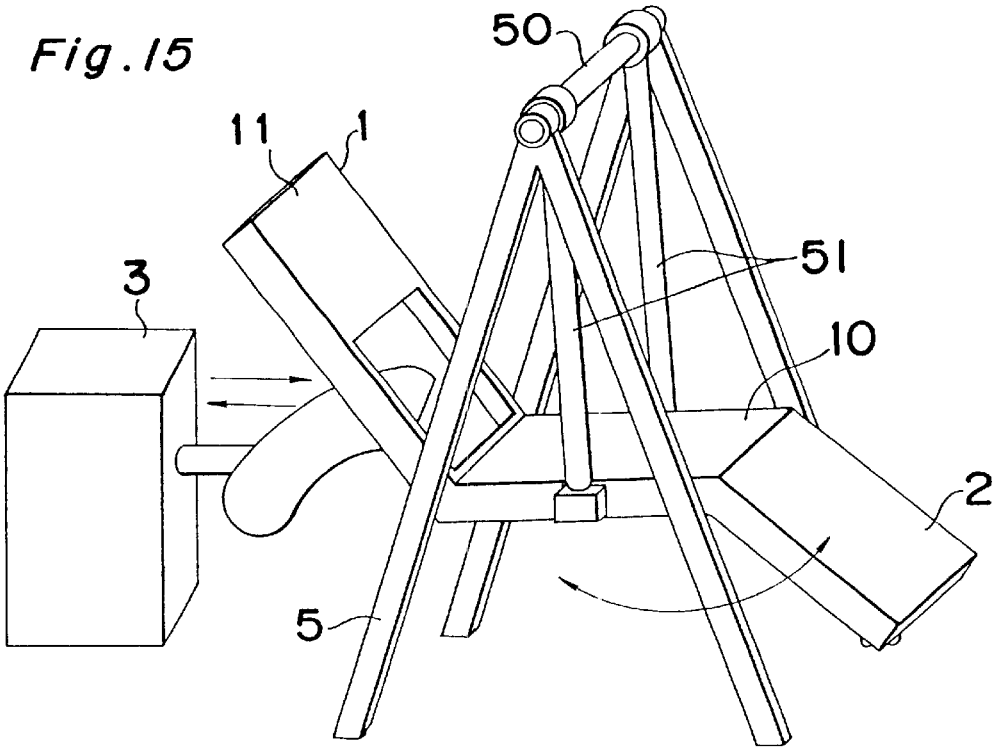
FIG. 15 is a schematic perspective view of the chair according to a further embodiment of the present invention.

The vibrating device (not shown in FIG. 14) is utilized to cyclically swing the chair 1 in a direction longitudinally thereof. However, since the distance between the stud shafts 53 is shorter than the distance between the stud shafts 55, the parallel cranking mechanism can cause the chair 1 to undergo the pitching vibration Xθ in the manner shown in FIG. 9.

Where the chair 1 forming the support means is so supported by the chair support structure that the chair 1 can be moved in a direction conforming to the direction of vibration applied by the vibrating device 3 such as shown in any one of FIGS. 13 and 14, the vibrating device 3 may be so designed and so positioned as to apply the force directly to the seat occupant as shown in FIG. 15, not to the support means or chair 1. In such case, the seat occupant can be cyclically swung together with the support means in a pattern identical with the pattern of movement of the support means.

Figure 16:
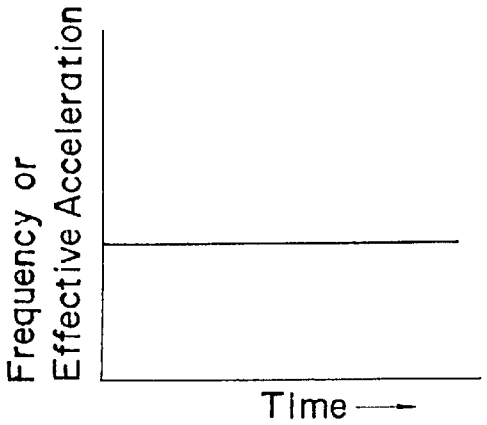
FIG. 16 is a graph illustrative of a pattern of vibration.
Figure 17:
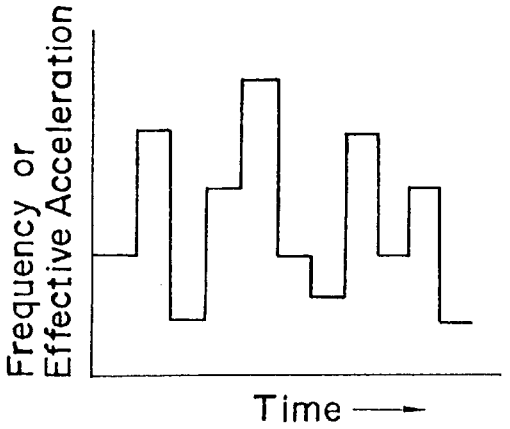
FIG. 17 is a graph illustrative of another pattern of vibration.
Figure 18:
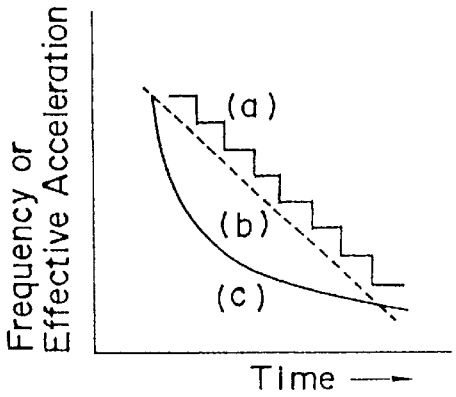
FIG. 18 is a graph illustrative of a different pattern of vibration.
Figure 19:
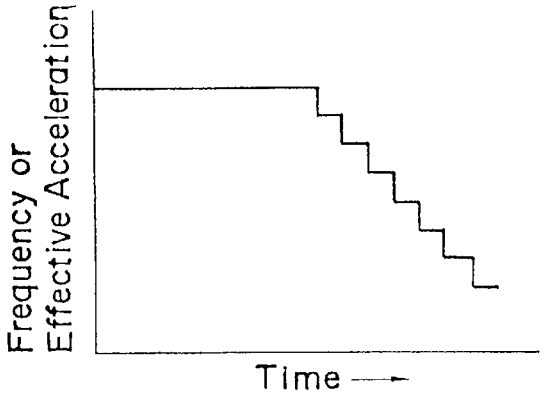
FIG. 19 is a graph illustrative of a further pattern of vibration.

As will be described later in connection with a control device 8, the relaxation apparatus of the present invention is provided with a vibratory mode selector by which the user can select one of a plurality of default vibratory modes. The default vibratory modes may include a simple vibratory mode in which the frequency and/or the effective value of acceleration are constant throughout the entire period of time during which the relaxation apparatus of the present invention is utilized as shown in FIG. 16; a 1/f fuzzy vibratory mode in which as shown in FIG. 17, the frequency and/or the effective value of acceleration fluctuate in a fashion based on the 1/f fluctuation pattern; a dwindling vibratory mode in which, as shown in FIG. 18, the frequency and/or the effective value of acceleration decrease progressively in a manner as indicated by any one of curves (a), (b) and (c); and a stepwise vibratory mode in which, as shown in FIG. 19, the frequency and/or the effective value of acceleration are kept constant for a predetermined length of time, but are progressively decreased upon elapse of the predetermined time; and a combination of those vibratory modes. Also, where the vibration is desired to be changed, it may be reduced to zero G at last, that is, it may be halted. It is to be noted that the pattern of vibration shown in FIG. 18 may not be limited to that shown by any one of the three curves (a), (b) and (c) shown therein.

Figure 20A:
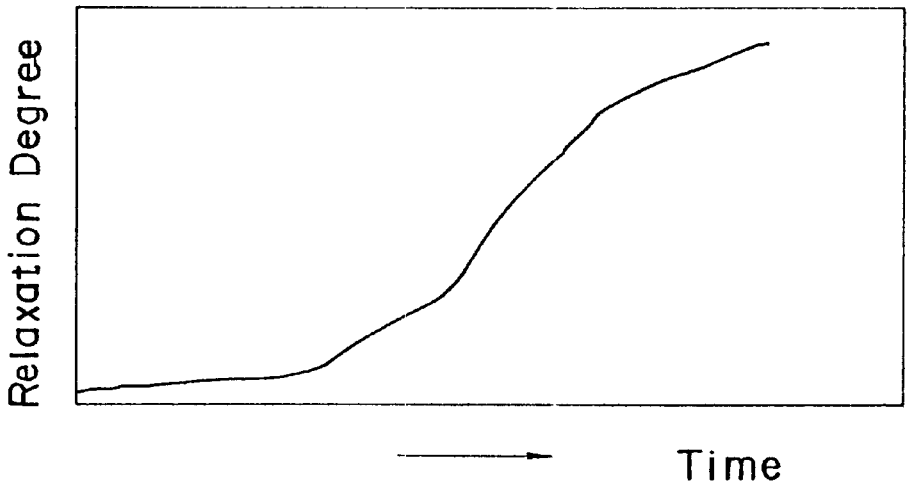
FIGS. 20A to 20C are graphs illustrative of change in vibration according to the degree of relaxation.
Figure 20B:
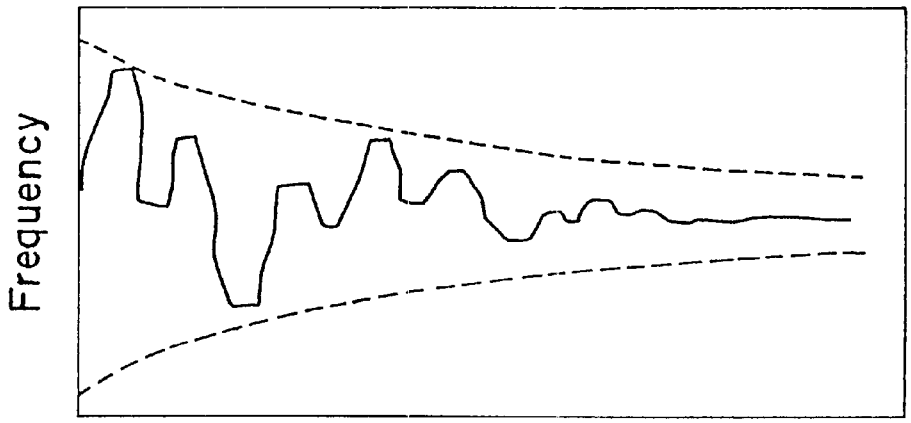
Figure 20C:
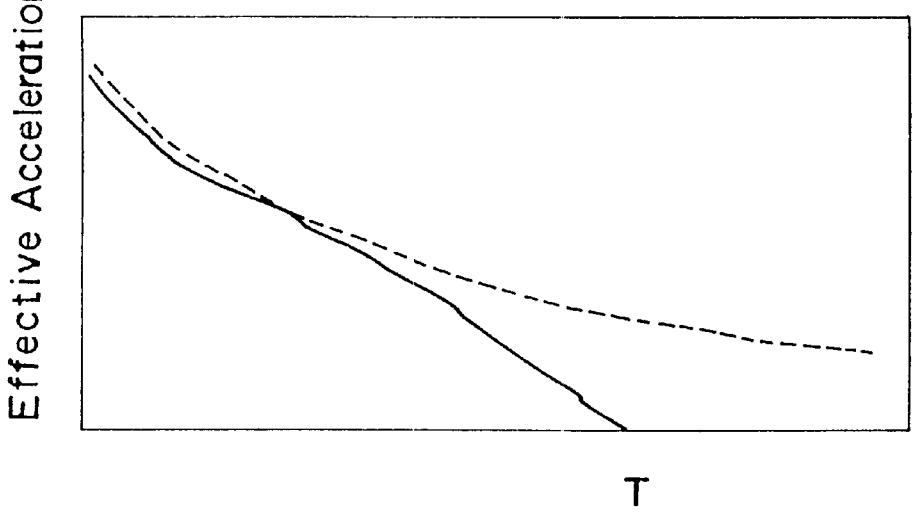
Figure 21A:
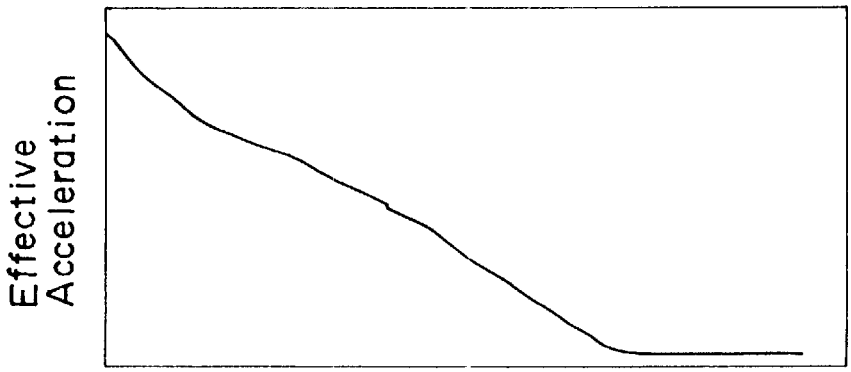
FIGS. 21A to 21D are graphs illustrative of change in vibration according to the degree of relaxation and application of another stimulus.
Figure 21B:
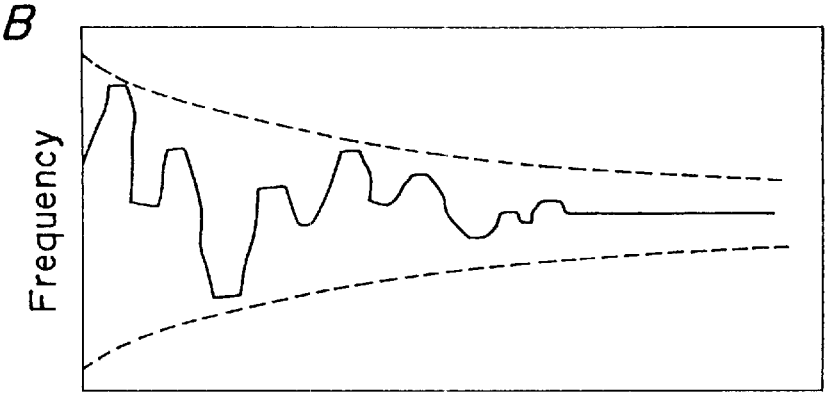
Figure 21C:
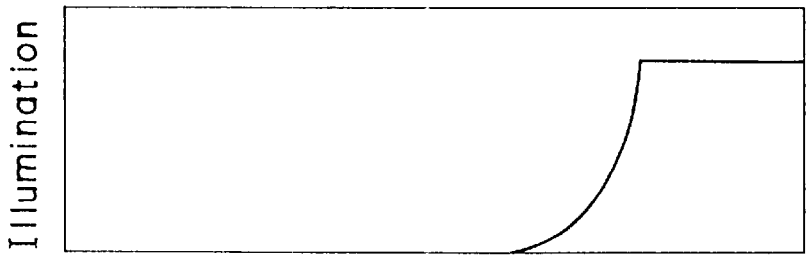
Figure 21D:
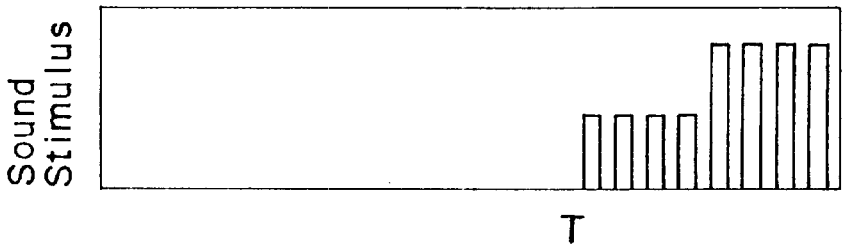

With respect to control of the acceleration, the use is preferred of an acceleration sensor 6 as shown in FIG. 1 to accomplish a feed-back control. The use of the acceleration sensor 6 is advantageous in that vibrations of a desired acceleration can be applied to the seat occupant without being adversely affected by the difference in load such as the difference in weight of potential seat occupants.

Where the vibration is desired to be changed, a relaxation sensor 7 capable of detecting the degree of relaxation felt by the seat occupant may be employed as shown in FIG. 1 so that with increase of the degree of relaxation detected as shown in FIG. 20A, fluctuation of the frequency of vibrations can be reduced (i.e., the extent of change of the frequency is reduced) as shown in FIG. 20B and/or the effective value of acceleration may be reduced as shown in FIG. 20C. It is to be noted that the point T represents the timing at which the seat occupant is deemed having slept and, therefore, at the timing T, the effective value of acceleration is zeroed. It is also to be noted in the graphs of FIGS. 20B and 20C, the dotted lines in FIG. 20B represent the extent to which the frequency is changed is narrowed and the dotted line in FIG. 20C represents the uppermost limit of the acceleration which decreases with increase of the degree of relaxation detected by the relaxation sensor 7.

The degree of relaxation felt by the seat occupant can be measured in terms of change in physiological characteristic such as brain wave (EEG), pulse rate, heartbeat, respiration rate, skin temperature, skin resistance and/or blood pressure. However, of those physiological characteristics, detection of the relaxation in terms of change in heartbeat or pulse rate is preferred because of the convenience. More specifically, the relaxation sensor disclosed in the Japanese Patent Application No. 8-5256 may be employed in the practice of the present invention.

It may happen that the seat occupant will fail to relax himself or herself for fear of oversleeping. To avoid this possibility, the vibrating device 3 may be so controlled by the control device 8 that upon arrival of the timing T the vibrating device 3 will be activated to place the chair under a predetermined vibratory condition (It is incidentally pointed out that in the illustration the vibration is taking place at a considerably low acceleration.) and, at the same time, the intensity of light from an illuminator lamp may be increased to provide an effective visual stimulus to the seat occupant and/or an aural stimulus may be applied to the seat occupant. Accordingly, even though the seat occupant has fallen into sleep during relaxation with the relaxation apparatus of the present invention, the seat occupant can be awaken in response to the tactile, visual and/or aural stimuli. Therefore, the seat occupant need not fear that he or she might fall into oversleep during relaxation with the relaxation apparatus of the present invention.

Also, arrangement may be made that regardless of or in addition to the use of the relaxation sensor 7, one or more stimuli for awaking the seat occupant can be outputted to inactivate or activate the vibrating device 3 after the passage of a predetermined time or when the number of cycles of vibrations attains a predetermined value.

Figure 22:
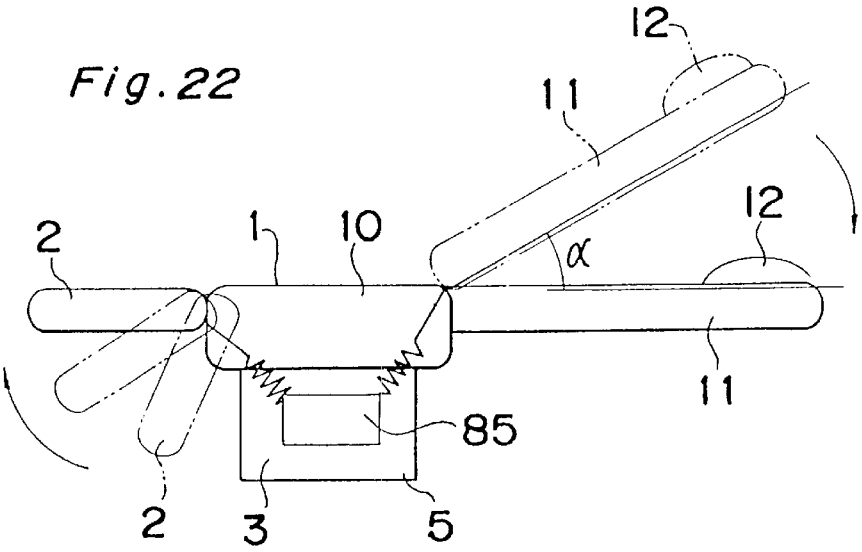
FIG. 22 is a schematic side view of the reclining chair equipped with an electrically powered reclining unit.

For the reclining chair 1 employed in the practice of the present invention, the use is preferred of an electrically powered reclining chair comprising an electric reclining unit 85 for electrically driving the back 11 and the footrest 2 relative to the seat 10 as shown in FIG. 22. The electric reclining unit 85 is preferably of a construction wherein not only can the angle of inclination of the back 11 relative to the seat 11 and that of the footrest 2 relative to the seat 11 be adjusted separately, but the footrest 2 can be automatically moved to a position flush with the seat 11 when the back 11 is upwardly inclined a predetermined angle a relative to the seat 11. The footrest 2 may be tilted to a position at which a free end of the footrest 2 opposite to the seat 11 comes above the plane of the top of the seat 11. Also, the electric reclining unit 85 may be of a type in which when the degree of relaxation outputted from the relaxation sensor 7 increases, or after the passage of a predetermined time, or when the number of cycles of vibrations attains a predetermined value, the back 11 can be tilted down to a full flat position and the footrest 2 can be tilted upwardly to the position flush with the seat 10.

Figure 23:
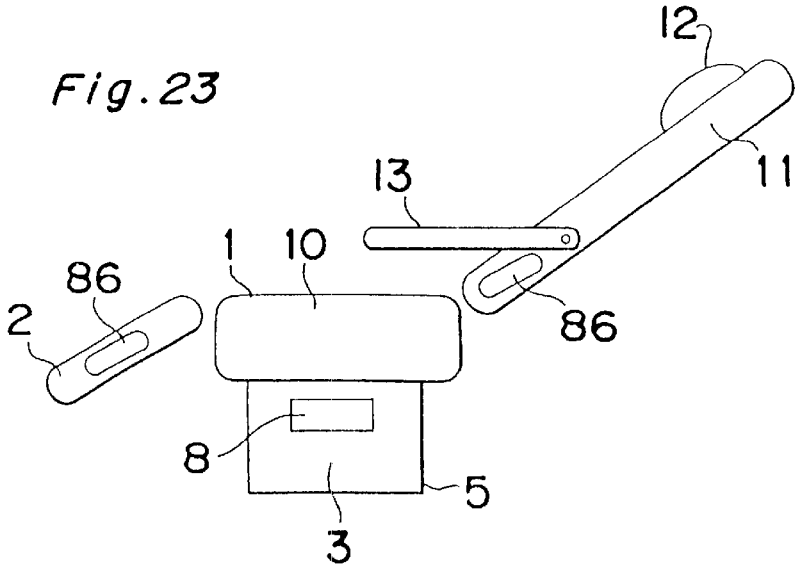
FIG. 23 is a schematic side view of the reclining chair equipped with local vibrating devices.

In the foregoing description, the vibrating device 3 has been shown as accomplishing a uniform vibration in the chair in its entirety. However, if desired, a localized vibration may be applied to only a portion of the body of the seat occupant such as, for example, back, waist or legs of the seat occupant. FIG. 23 illustrates an example in which separate from the vibrating device 3 used to vibrate only the seat 10, additional two vibrating devices 86 are used and built in the footrest 2 and a lower region of the back 11, respectively, for applying vibrations to the legs and the back of the seat occupant, respectively. Thus, it will readily be seen that the legs and waist of the seat occupant resting on the footrest 2 and the back 11, respectively, would be applied vibrations which are produced respectively by the additional vibrating devices 86, but are overlapped with vibration produced by the vibrating device 3. Unlike the vibration to be applied uniformly to the entire body of the seat occupant, the vibration generated by each of the additional vibrating devices 86 may suffice to be of a frequency not higher than 300 Hz and preferably within the range of 10 to 60 Hz, at which time the frequency of vibration used to vibrate the entire body of the seat occupant is moderate of a few Hz.

In place of or in combination with the locality vibrating devices 86, a massaging means M, a heating means H and/or a cooling means C may be employed in the chair.

Figure 24:
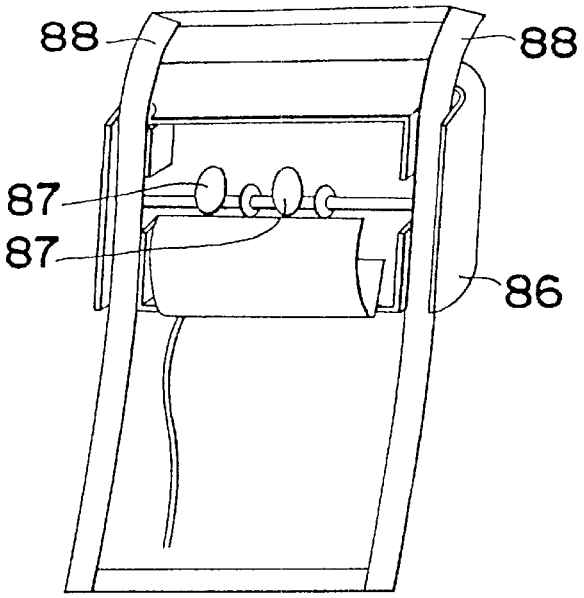
FIG. 24 is a schematic perspective view of a back of the reclining chair, showing the use of a massaging device.
Figure 25:
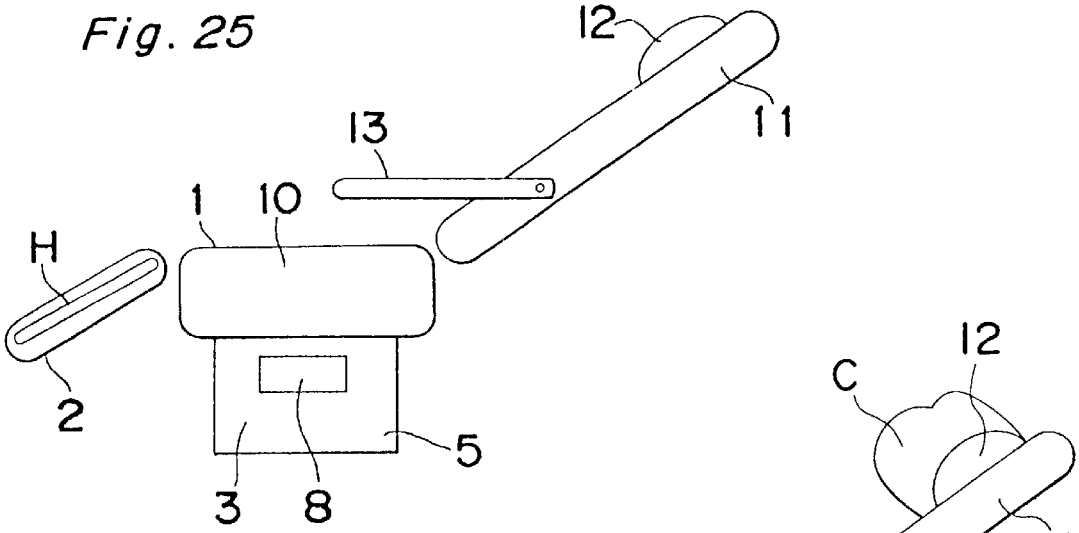
FIGS. 25 and 26 are schematic side views of the reclining chair equipped with a heating means and a cooling means, respectively.

FIG. 24 illustrates the use of the massaging means M incorporated in the back 11 of the chair. As shown therein, the massaging means M includes a plurality of, for example, two, rollers 87 capable of moving along longitudinal frames 88 of the back 11 and adapted to cyclically apply a rubbing, pounding or pressing action to the back of the seat occupant resting on the back 11 of the chair. Preferably, the cycle of massaging accomplished by the massaging means M is synchronized with the frequency of vibration imparted by the vibrating device 3.

The heating means H and the cooling means C may be incorporated in any one of the back 11, the seat 10 and the footrest 2. Where the heating means H is to be installed in only one of them, the heating means H is preferably incorporated in the footrest 2 as shown in FIG. 15. Heating of the seat occupant moderately by means of the heating means H is effective to allow the seat occupant to relax under a discomfort condition with a low temperature.

Figure 26:
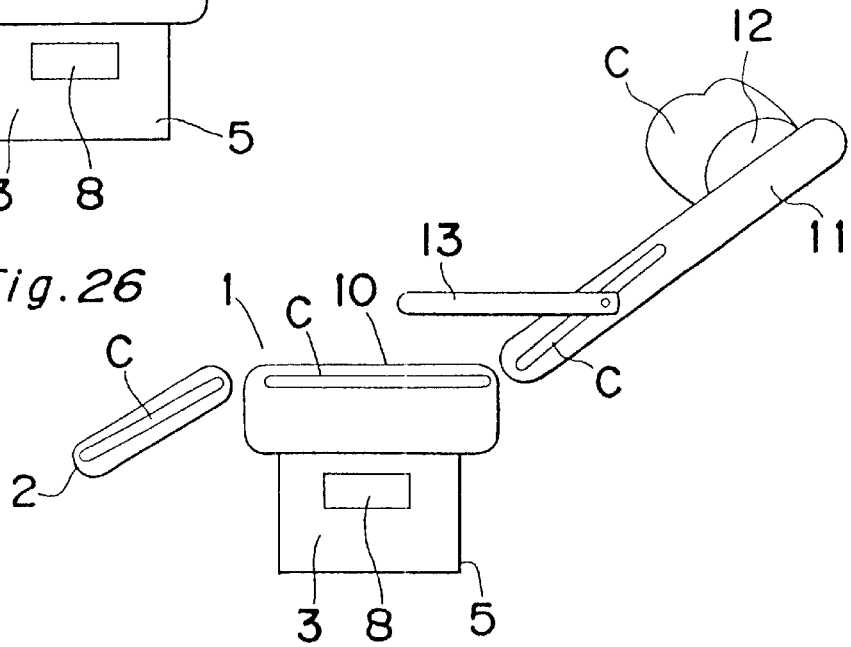

FIG. 26 illustrates the use of the cooling means C incorporated in each of the footrest 2, the seat 10, the reclining back 11 and the headrest 12. In the example shown in FIG. 26, the cooling means C in any one of the footrest 2, the seat 10, the reclining back 11 and the headrest 12 is so arranged and so positioned as to surround the corresponding footrest, seat, reclining back or headrest from left and right sides thereof. However, the cooling means C may not be so arranged and positioned as described above, and instead, the cooling means C may be incorporated only one or more of the footrest, the seat, the reclining back and the headrest. For example, the cooling means C may be used in each of the footrest 2 and the seat 10 or in the headrest 12 so as to surround it from the left and right sides thereof, or in the footrest 2 and the headrest 12 so as to surround them from the left and right sides thereof. Cooling by the cooling means C may be accomplished by thermal conduction, radiation or convection.

In any event, the use of the cooling means C is particularly advantageous in that under a discomfort condition with a high temperature the seat occupant can be effectively relaxed by cooling the body of the seat occupant.

Figure 27:
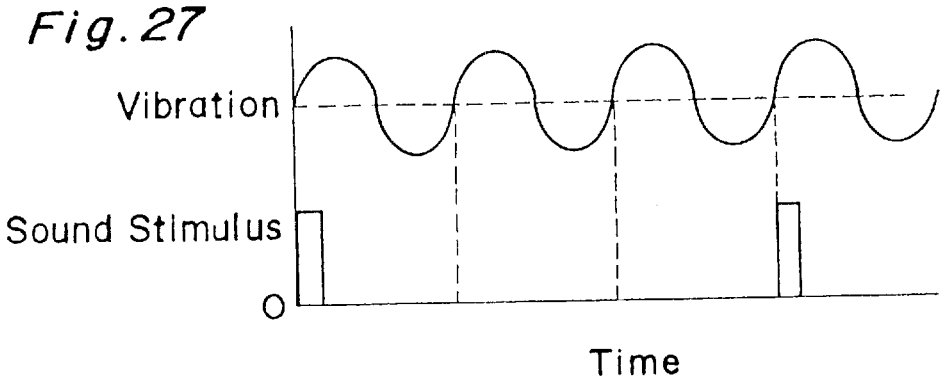
FIG. 27 is a time chart of operation in which an auxiliary stimulus is applied.
Figure 28:
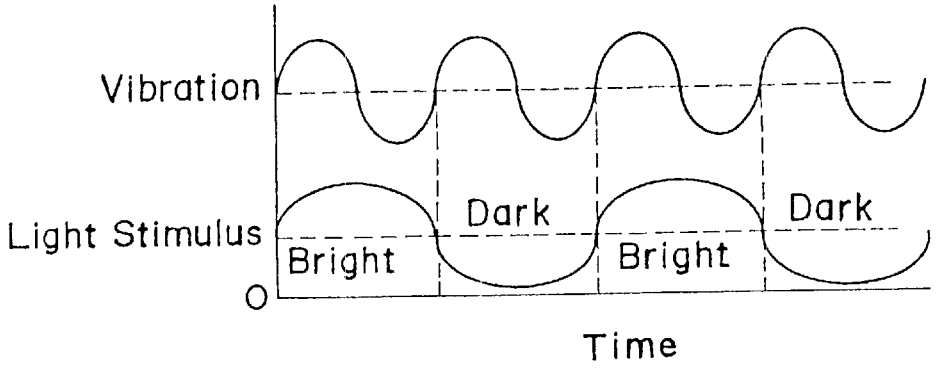
FIG. 28 is a time chart of operation in which a different auxiliary stimulus is applied.

The use of an auxiliary stimulating means for providing the seat occupant with a different kind of stimuli synchronized with the rocking motion, in addition to the tactile stimuli brought about by the rocking motion. FIG. 27 illustrates a system in which an aural stimuli is generated at a frequency which is one third of the frequency of vibration, that is, three times the cycle of rocking motion, produced by the vibrating device 3, and FIG. 28 illustrates a system in which a visual stimuli in the form of a blinking illumination is generated at a frequency which is one half of the frequency of vibration, that is, double the cycle of swinging motion produced by the vibrating device 3. Other than the aural and visual stimulus, an olfactory stimulus may also be employed. Where the olfactory stimuli is employed, it may be outputted regardless of the frequency of the rocking motion produced by the vibrating device 3. These auxiliary stimulus may be of a predetermined level, but the level of each of these auxiliary stimulus may be varied low and high depending on the level of output of the swinging motion produced by the vibrating device 3 and/or the degree of relaxation of the seat occupant.

The control device 8 for controlling the vibrating device 3 may be conveniently employed in the form of a microcomputer. Control of the operation is easy to accomplish where vibrations is desired to be matched with or varied according to respective values detected by the acceleration sensor 6 and the relaxation sensor 7. The control device 8 can also control the electric reclining unit 85, the locality vibrating devices 86, the massaging means M, the heating means H, the cooling means C and aural and visual stimuli generating means for awaking the seat occupant and for providing the auxiliary stimulus discussed above. The control device 8 may be so programmed as to permit the seat occupant to operate the relaxation apparatus of the present invention in a manner as shown in the flowchart of FIGS. 30A to 30D.

Specifically, the seat occupant can select the mode of vibration at his or her will. By way of example, in the case of a physical fatigue or stiff shoulders, the seat occupant can feel as if massaged when the seat occupant is oscillated at a relatively high frequency, say, about 10 Hz or higher, or can feel relieved mentally when oscillated at a relatively low frequency of, for example, 0.1 to 3 Hz. In the event of a severe muscular fatigue, the seat occupant can be relieved if after the muscle has been massaged by the massaging means M a moderate vibration or a vibration sufficient to allow the seat occupant to feel as if massaged lightly is applied to the seat occupant.

Alternatively, where the seat occupant wishes to take a nap for a moment in a relaxed condition, the frequency of vibration and the acceleration are to be controlled by measuring the degree of relaxation with the relaxation sensor 7 so that the seat occupant can be relaxed with the mode of vibration sufficient to allow the seat occupant to feed as if massaged lightly and, at the same time, the angle of inclination of the seat back 11 is to be slowly decreased to bring the seat back 11 to a horizontal flat position. When a predetermined length of time which has been set to avoid a possible oversleeping has passed, a stimuli is applied to awake the seat occupant.

Hereinafter, the details of the control device 9 including its structure and function will be described with particular reference to FIGS. 30A to 30D. It is, however, to be noted that the program flows shown therein are particularly applicable where the support means is employed in the form of the reclining chair 1 of the structure having the respective functions shown in FIGS. 22, 23, 25 and 26, that is, equipped with the electric reclining unit 85 for electrically driving the back 11 and the footrest 2 relative to the seat 10, the locality vibrating devices 86 for applying vibrations to the legs and the back of the seat occupant, respectively, the heating means H, and the cooling means C.

Figure 30A:
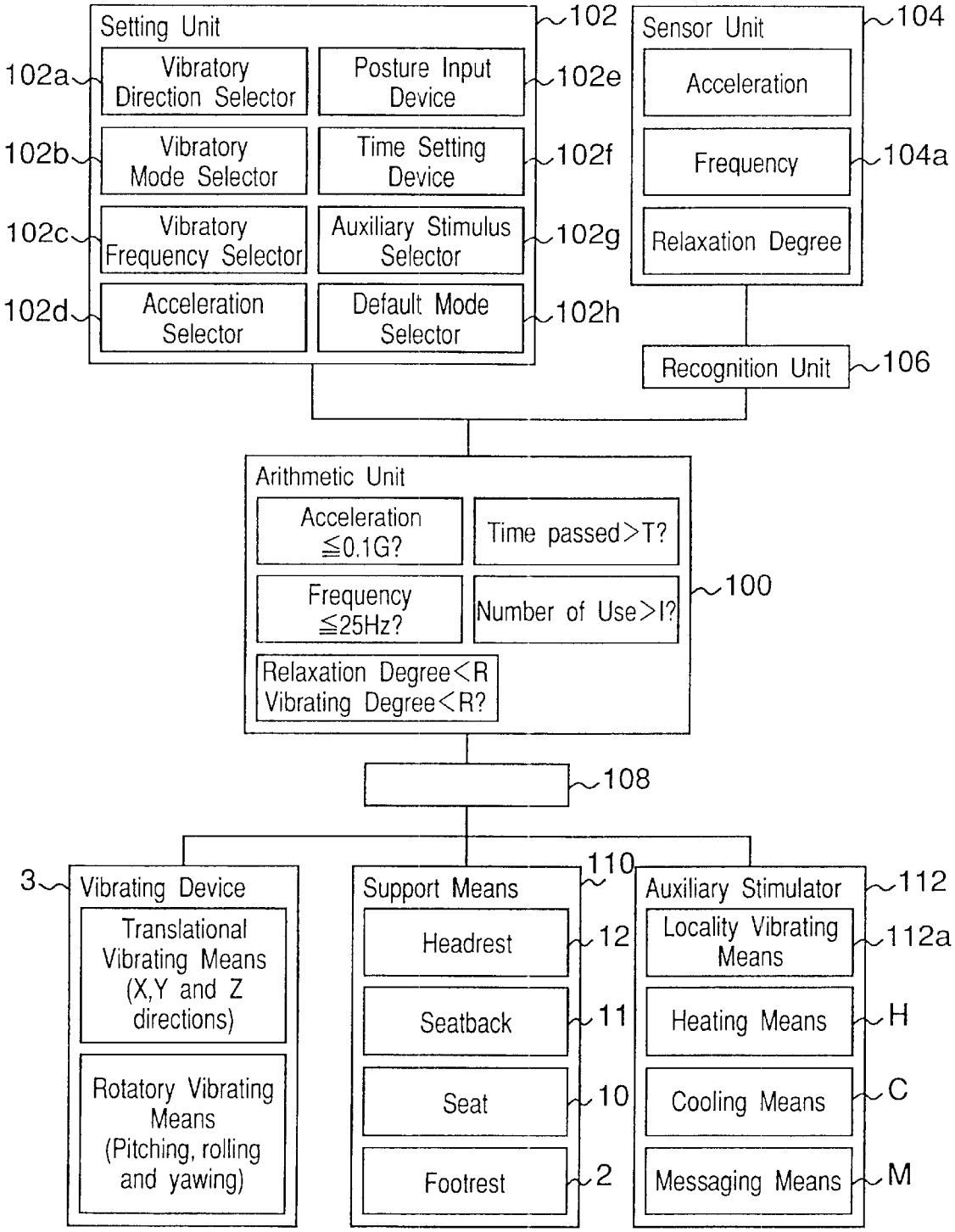
FIG. 30A is a block diagram showing the relaxation apparatus according to the present invention.

As best shown in FIG. 30A, the control device 8 includes an arithmetic unit 100, a setting unit 102, a detecting unit 104, a recognition unit 104, and an interface 108. The setting unit 104 is a device external to the arithmetic unit 100 and may comprise a hand-held controller or a controller that may be either permanently or detachably fixed to a suitable portion to the reclining chair 1. In either case, the setting unit 102 is electrically connected with the arithmetic unit 100 to supply the arithmetic unit 100 with parameters that can be set by the user.

Specifically, the setting unit 102 includes a vibratory direction selector 102*a* for selecting one of vibratory directions desired by the seat occupant, that is, one of cyclic forward and rearward movement (vibration in a direction conforming to the longitudinal sense of the user desiring relaxation), cyclic leftward and rightward movement (vibration in a direction leftward and rightward of the user), pitching, rolling and yawing; a vibratory mode selector 102*b* for selecting one of vibratory patterns (such as the simple vibratory mode shown in FIG. 16, the 1/f fuzzy vibratory mode shown in FIG. 17 and so on) desired by the seat occupant; a vibratory frequency selector 102*c* for setting a desired frequency of vibration to be produced by the vibrating device; an acceleration selector 102*d* for setting a desired acceleration to be produced on the seat occupant; a posture input device 102*e* for inputting information associated with the posture of the seat occupant, that is, information on one or both of respective positions of the seatback 11 and the footrest 2; a time setting device 102*f* for inputting the length of time during which the relaxation apparatus is used (that is, either the length of time of application of the vibration or the number of times of use of the relaxation apparatus): an auxiliary stimulus selector 102*g* for selecting one of the auxiliary stimuli including visual stimulus, aural stimulus, heating, cooling and massaging; and a default mode selector 102*h* for executing a predetermined action including at least one of execution of a pattern that is different from the vibratory pattern selectable by the mode selector 102*b* and in which the applied vibration is progressively attenuated or faded out, and application of an awaking stimulus.

The detecting unit 104 includes, in addition to the acceleration sensor 6 and the relaxation sensor 7 both referred to hereinbefore, a frequency sensor 104*a*. Respective information from those sensors 6, 7 and 104*a* are, after having been converted into digital signals by the recognition unit 106, supplied to the arithmetic unit 100.

The arithmetic unit 100 operates, based on various parameters supplied from the setting unit 102 and the detecting unit 104, to determine if the detected acceleration, the detected frequency, the detected relaxation degree, the preset time of use and the number of times of use exceed respective predetermined values. More specifically, if the acceleration is equal to or lower than 0.1 G, the frequency is equal to or lower than 25 Hz, the degree of relaxation is smaller than a predetermined value Rel, the length of time of use is shorter than a predetermined value Time and the number of times of use is smaller than a predetermined value 1, the arithmetic unit 100 provides an output to the interface 108. The arithmetic unit 100 executes the program flows shown in FIGS. 30B to 30D, reference to which will be made subsequently.

It is to be noted that the degree of relaxation felt by the seat occupant can be inferred from change in brain wave, pulsation, heartbeat, skin temperature, electric skin resistance and/or blood pressure and can be determined by comparison of increments of respective lengths of time each required for the heartbeat to attain one and the same predetermined value. By way of example, as is well known to those skilled in the art, the heartbeat is relatively low when a person is relaxed. In view of this, the length of time required for the heartbeat to attain a predetermined value increases as the degree of relaxation increases. The technique to detect the degree of relaxation referred to above is well known in the art from, for example, the Japanese Laid-open Patent Publication No. 9-70399, published Mar. 18, 1997, the disclosure of which is hereby incorporated by reference. The relaxation sensor disclosed in such publication may therefore be employed in the practice of the present invention.

The interface 108 is operable to distribute the output signal from the arithmetic unit 100 to one or some of the vibrating device 3, the support means 110 and the auxiliary stimulus means 112 depending on the type of the output signal from the arithmetic unit 100 so that the vibrating device 3, the support means 110 and the auxiliary stimulus means 112 can operate in response to signals supplied from the interface 112. The support means 110 requires a control signal from the arithmetic unit 100 where one or both of the footrest 2 and the seatback 11, forming a part of the electrically powered reclining chair 1 are angularly adjusted by an electric, hydraulic or pneumatic drive motor (not shown), that is, where the reclining chair 1 has various, independently controllable functional units such as shown in FIGS. 22, 23, 25 and 26 as hereinbefore described.

On the other hand, the auxiliary stimulus means 112 comprises at least one of a locality vibrating means 112*a* including one or both of the additional locality vibrating devices 86 as shown in FIG. 23, the heating means H, the cooling means C and the massaging means M. As hereinbefore described, the auxiliary stimulus means 112 may further comprise an awaking means which may be one or both of the aural stimulator and the visual stimulator.

Figure 30B:
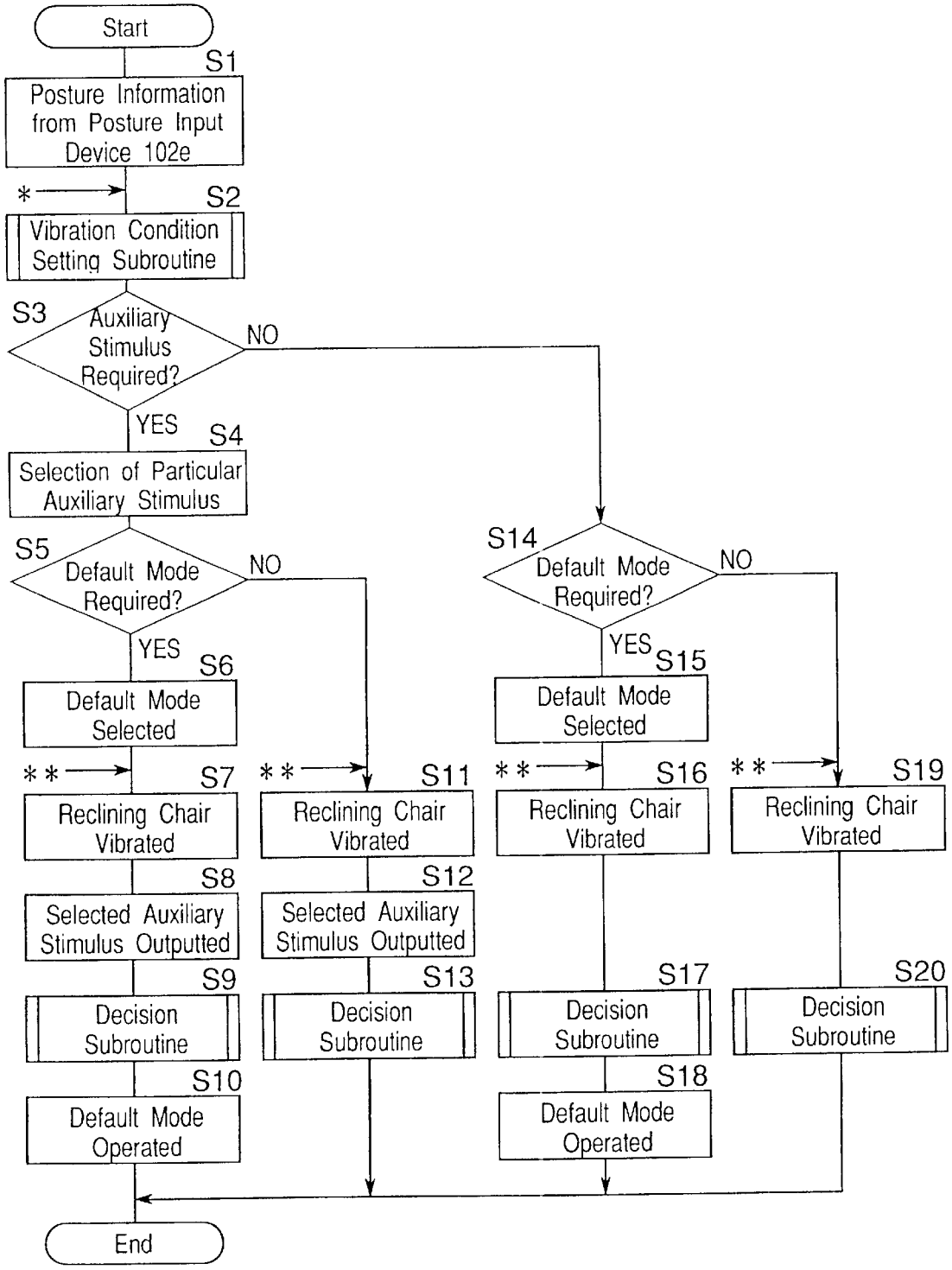
FIG. 30B is a flowchart showing the sequence of operation of the relaxation apparatus according to the present invention.
Figure 30C:
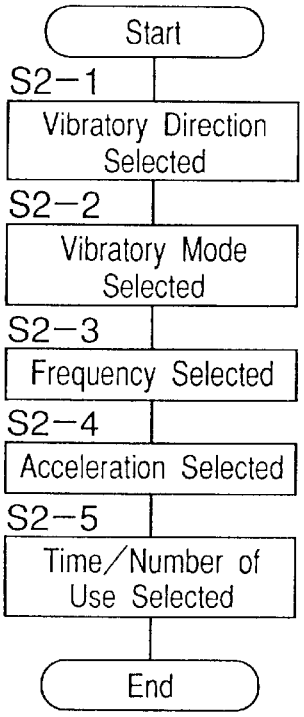
FIGS. 30C and 30D are flowcharts showing respective subroutines executed in the course of the flow shown in FIG. 30B.
Figure 30D:
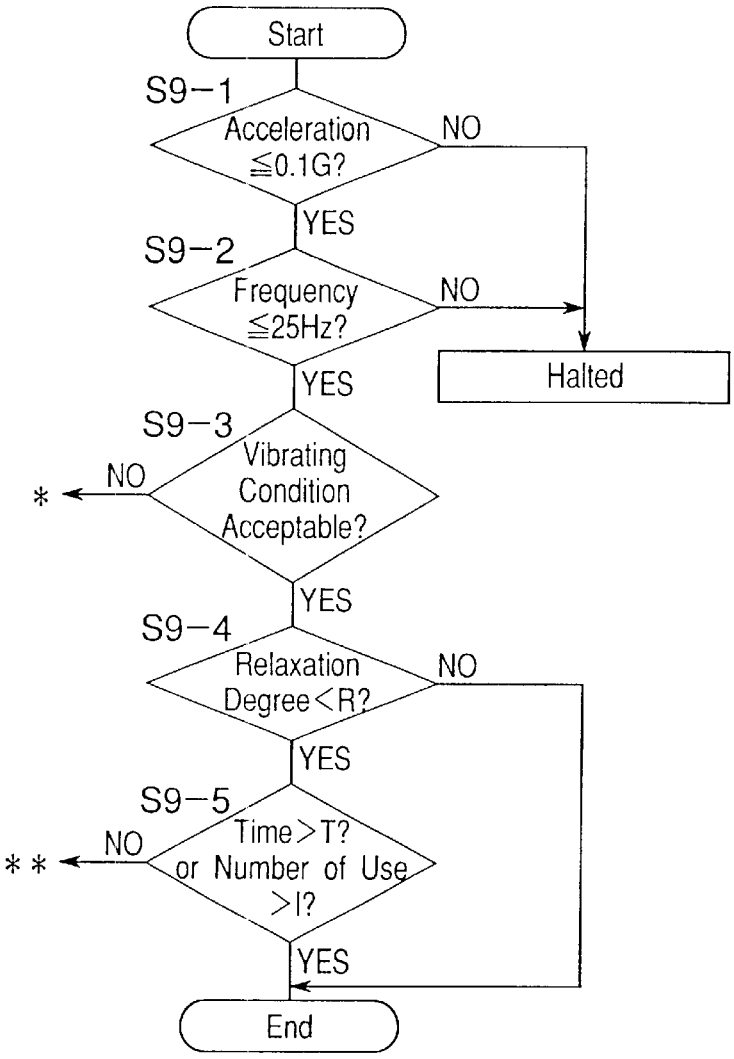

The sequence of operation of the control device 8 of the structure described above is implemented by a computer executable software which will now be described. FIG. 30B shows a main routine executed by the control device 8, and subroutines executed during the course of the main routine are shown respectively in FIGS. 30C and 30D. As hereinbefore described, the program flow shown in FIGS. 30B to 30D are applicable where the reclining chair 1 is of the structure equipped with the electric reclining unit 85 for electrically driving the back 11 and the footrest 2 relative to the seat 10, the locality vibrating devices 86 for applying vibrations to the legs and the back of the seat occupant, respectively, the heating means H, and the cooling means C.

In summary, this control device 8 is so designed as to control the acceleration in dependence on the frequency of vibrations outputted by the vibrating device such that the effective acceleration is small when the frequency of vibrations outputted by the vibrating device is low while the acceleration is large when the frequency of vibrations is high. This relationship is illustrated in the graph of FIG. 37 wherein any of numerical combinations of the effective acceleration and the frequency falling within a hatched area has been found acceptable in the sense that the relaxation apparatus of the present invention is effective to lead the seat occupant to relaxation satisfactorily.

Referring first to FIG. 30B, subsequent to the start of operation of the control device 8, information descriptive of the posture of the seat occupant on the reclining chair 1 is inputted from the posture input device 102*e* at step S1. The posture of the seat occupant on the reclining chair 1 may be represented by, for example, the position of the seatback 11 relative to the seat 10 within the range of 90 to 180° and/or the position of the footrest 2 relative to the seat 10 within the range of 90 to 180°. As a matter of design, when the seatback 11 is tilted down to a 180° position generally in flush with the seat 10 and the footrest 2 is similarly tilted up to a 180° position generally in flush with the seat 10, the reclining chair 1 as a whole can be held in a generally flat position allowing it to be used as a bed.

At step S2, the subroutine for setting a vibrating condition is executed. As will be described in detail later, this can be accomplished by manipulating some of the devices of the setting unit 102 that are associated with the vibrating condition to input the desired parameters.

Specifically, referring to FIG. 30C, the vibrating condition is determined by first selecting the desired vibratory direction by means of the vibratory direction selector 102*a* at step S2-1, then selecting the desired vibratory pattern by means of the vibratory mode selector 102*b* at step S2-2, selecting the desired frequency by means of the frequency selector 102*c* at step S2-3, selecting the desired acceleration by means of the acceleration selector 102*d* at step S24, and finally selecting the time passed T or the number of use I by means of the time setting device 102*f* before the program flow returns to the main routine.

Once the vibrating condition is chosen, a decision is made at step S3 to determine if the seat occupant is desirous of utilizing the auxiliary stimulus. Whether or not the seat occupant desires to enjoy the auxiliary stimulus depends on whether or not that the auxiliary stimulator 102*g* has been manipulated. In the event that the decision block S3 indicates that the auxiliary stimulator 102*g* has been manipulated as indicated by "Yes", the program flow goes to step S4 at which the particular auxiliary stimulus selected by the auxiliary stimulus selector 102*g* is set in position ready to act. Thereafter, at step S5, a decision is made to determine if the seat occupant requires a default mode and, if so determined, the default mode by the default mode selector 102*h* is set in position ready to be executed at step S6, followed by step S7 at which the vibrating device 3 is activated to vibrate the reclining chair 1.

Substantially simultaneously with activation of the vibrating device 3, the selected auxiliary stimulus is outputted at step S8. Specifically, where, for example, the heating and the aural stimulus have been selected by manipulating the auxiliary stimulus selector 102*g*, not only is the heating means H activated, but the aural stimulator is also activated to produce a background music.

Through the process of steps S1 to S8 the reclining chair 1 is vibrated to cyclically move the seat occupant and the auxiliary stimulus is also applied to the seat occupant. However, while the seat occupant is vibrated to lead him or her to relaxation, and at step S9, the decision subroutine shown in FIG. 30D is executed during which respective decisions of whether the applied acceleration is equal to or less than the predetermined value (0.1 G), whether the applied frequency is equal to or lower than 25 Hz, whether the degree of relaxation is smaller than the predetermined value Rel, whether the length of time of use is shorter than the predetermined time Time, whether the number of times of use is smaller than the predetermined value I are performed successively.

Referring to FIG. 30D, a decision is first made at step S9-1 to determine if the acceleration is equal to or less than the predetermined value (0.1 G). Should the acceleration be equal to or less than the predetermined value, the subsequent decision is carried out at step S9-2 to determine if the frequency is equal to or lower than 25 Hz. If consequent upon the result of decision at step S9-2 the frequency is found equal to or lower than the predetermined value, a query is displayed to the seat occupant through a display device (not shown) at step S9-3 to make the seat occupant ascertain if the vibrating conditions so selected and so set are acceptable to him or her. Once the selected vibrating conditions have been ascertained as acceptable as indicated by "Yes" at step S9-3 and are subsequently transmitted to the control device 8, the actual degree of relaxation is determined at step S9-4 in reference to the relaxation signal supplied from the relaxation sensor 7.

In the event that the degree of relaxation represented by the relaxation signal from the relaxation sensor 7 is lower than the predetermined value Rel as determined at step S94, a decision is subsequently made at step s9-5 to determine if the length of time of use is shorter than the predetermined time Time or if the number of times of use is smaller than the predetermined value 1. When either one of the conditions is satisfied at step S9-5 as indicated by "Yes", the subroutine of FIG. 30D terminates and the program flow returns to the main routine of FIG. 30B, particularly to step s10 thereof at which the default mode set at step S6 is executed.

Referring to step S5 and should the default mode be not required as indicated by "No", it means that no input is made to the default mode selector 102*h* and a process from step S11 to step S13 that is similar to the process from step S7 to step S9 is carried out, with the vibrating device 3 consequently activated with no default mode.

In the event that as a result of the decision at step S3, no auxiliary stimulus is required as indicated by "No", it means that no input is made to the auxiliary stimulus selector 102*g* and, therefore, steps S14, S15, S16, S17 and S18 that are similar to the previously described steps S5, S6, S7, S9 and S10, respectively, are successively carried out. However, if at step S14 the default mode is determined unnecessary as indicated by "No", steps S19 and S20 similar to the previously described steps S11 and S13, respectively, are carried out successively.

It is to be noted that the decision subroutine that is carried out at each of steps S13, S17 and S20 is identical with that carried out at step S9 and shown in FIG. 30D. However, in the event that the respective parameters determined at steps S9-1 and S9-2 are determined greater than the associated predetermined values as indicated by "No", the vibrating device 3 is brought to a halt at step S9-6 as shown in FIG. 30D. On the other hand, where as a result of decision at step S9-3 the vibrating conditions selected and set are deemed undesirable as indicated by "No", the program flow returns to the main routine, particularly to step S2, with the program flow consequently repeated until the desirable vibrating conditions are selected and set.

In the event that the result of decision at step S9-5 of the subroutine indicates that the length of time of use exceeds the predetermined time Time or the number of times of use is greater than the predetermined value 1, the program flow returns to step S7, S11, S16 or S19 depending on the preceding step S8, S12, S17 or S20, respectively.

It is to be noted that if at steps S9-1 and S9-2, the respective parameters exceed the associated predetermined value, the vibrating device 3 is brought to a halt. However, instead of the vibrating device 3 being brought to a halt, arrangement may be so made that the program flow returns from step S9-1 or S9-2 to step S2 of the main routine, so that the vibration outputted from the vibrating device 3 can be maintained at a level equal to or less than 0.1 G and at a frequency equal to or not higher than 25 Hz.

The foregoing is illustration of one of numerous manners of use of the relaxation apparatus of the present invention, although there is no limit to the applications of the relaxation apparatus of the present invention. In any event, since where the seat occupant wishes to be mentally relieved by the moderate vibration of a relatively low frequency, for example, 0.1 to 3 Hz, the direction of propagation of the vibration and the presence or absence of rotation may vary from person to person and, therefore, selection and setting can be achieved at any time before or after the use of the relaxation apparatus according to the seat occupant's desire.

Figure 29:
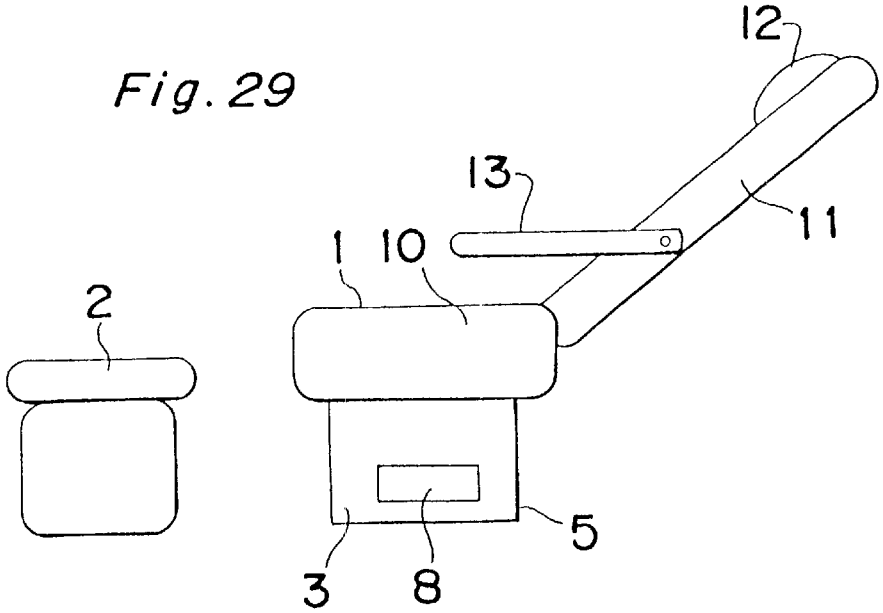
FIG. 29 is a schematic side view of the reclining chair according to a still further embodiment of the present invention.

The support means may not be always limited to the reclining chair 1 and the footrest 2. A bed may be equally employed for the support means. Also, the support means may not be limited to the type effective to support the entire body of the seat occupant, but may be of a type capable of applying the vibration only to the upper half of the seat occupant. By way of example, the footrest 2 may be separate from the seat 10 as shown in FIG. 29.

When during a series of experiments conducted by the inventors the reclining chair 1 shown in FIG. 1 is vibrated using various combinations of the acceleration and the vibratory frequency, the seat occupant has indicated that he could be sufficiently relaxed when a combination of 12 Hz and 0.02 G or 1.5 Hz and 0.01 G was employed during the vibration in the direction Y, or a combination of 0.5 Hz and 0.008 G was employed during the pitching. On the other hand, the seat occupant indicated that the combination of 1.5 Hz and 0.1 G during the vibration in the direction Y and the combination of 0.5 Hz and 0.04 G during the pitching were unacceptable.

At a low frequency region not higher than 3 Hz, vibration is sensed by cerebellum and semicircular canals, not by a receptor of the sense of vibration. Of the receptor senses, Meissner's corpuscles, Pacini's corpuscles, Merkel's tactile meniscus and Ruffini's corpuscles are known to be vibration senses. In particular, the Meissner's and Pacini's corpuscles are sensitive to the stimulus of vibration of a low amplitude. The Meissner's corpuscles tends to exhibit a U-shaped pattern having a minimum threshold at 20 to 30 Hz as a function of the frequency of the stimulus. Although the Pacini's corpuscles are also sensitive to the vibration of 20 to 30 Hz, the threshold amplitude thereof is relatively high as compared with the Meissner's corpuscles. See Oyo Butsuri (Applied Physics), Vol. 54, No. 4, 1985, pp. 368–372.

Accordingly, at a frequency not lower than a few Hz, the vibration of up to 25 Hz to which only the Meissner's corpuscles sensitive to the low amplitude are sensitive appears to be convenient.

Figure 31:
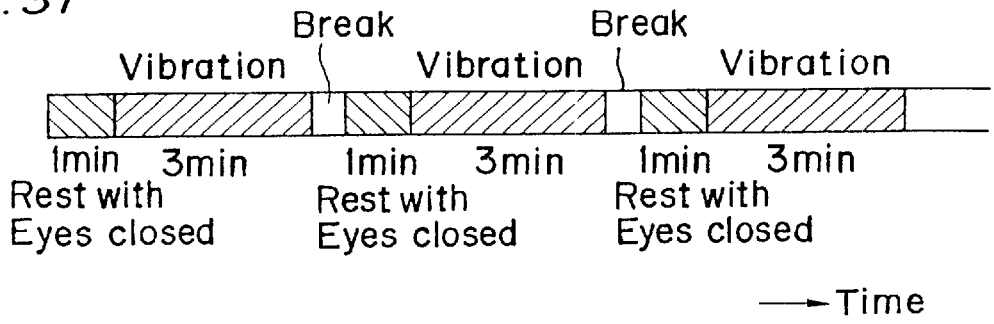
FIG. 31 is a schematic diagram showing a time schedule according to which experiments have been conducted.

So far as the acceleration level is concerned, researches were conducted to determine it in relation to the degree of relaxation. Results of experiments conducted at 0.5 Hz, 1.5 Hz and 12 Hz according to a time schedule shown in FIG. 31 will now be described.

Conditions under which the experiments were conducted are shown in Table 1 below:

TABLE 1

| Direction of Axis of Vibration and Type | Frequency | Acceleration Level Low | Acceleration Level High |
|---|---|---|---|
| Y Translational | 12 Hz | 0.02 G | 0.2 G* |
| Y Translational | 1.5 Hz | 0.01 G | 0.1 G* |
| X Pitching | 0.5 Hz | 0.008 G | 0.04 G** |

*: Measured sideways.
**: Measured aft and fore.

Using the reclining chair shown in FIG. 1, brain waves and heartbeat were measured. During the measurement of the brain waves, measuring electrodes were positioned according to the International 10-20 Lead Montage, that is, F3-A2, C3-A2 and O1-A2.

Change in brain wave was examined to determine whether or not the healthy subject, 27 years old male weighing 60 Kg, could be relaxed. Examples of the test results are shown in FIGS. 32A to 32F. The brain waves shown in each of FIGS. 32A and 32B were obtained when the vibration of 12 Hz in frequency was exposed; those shown in each of FIGS. 32C and 32D were obtained when the translational vibration of 1.5 Hz was exposed; and those shown in each of FIGS. 32E and 32F were obtained when the pitching vibration of 0.5 Hz was exposed.

Figure 32A:
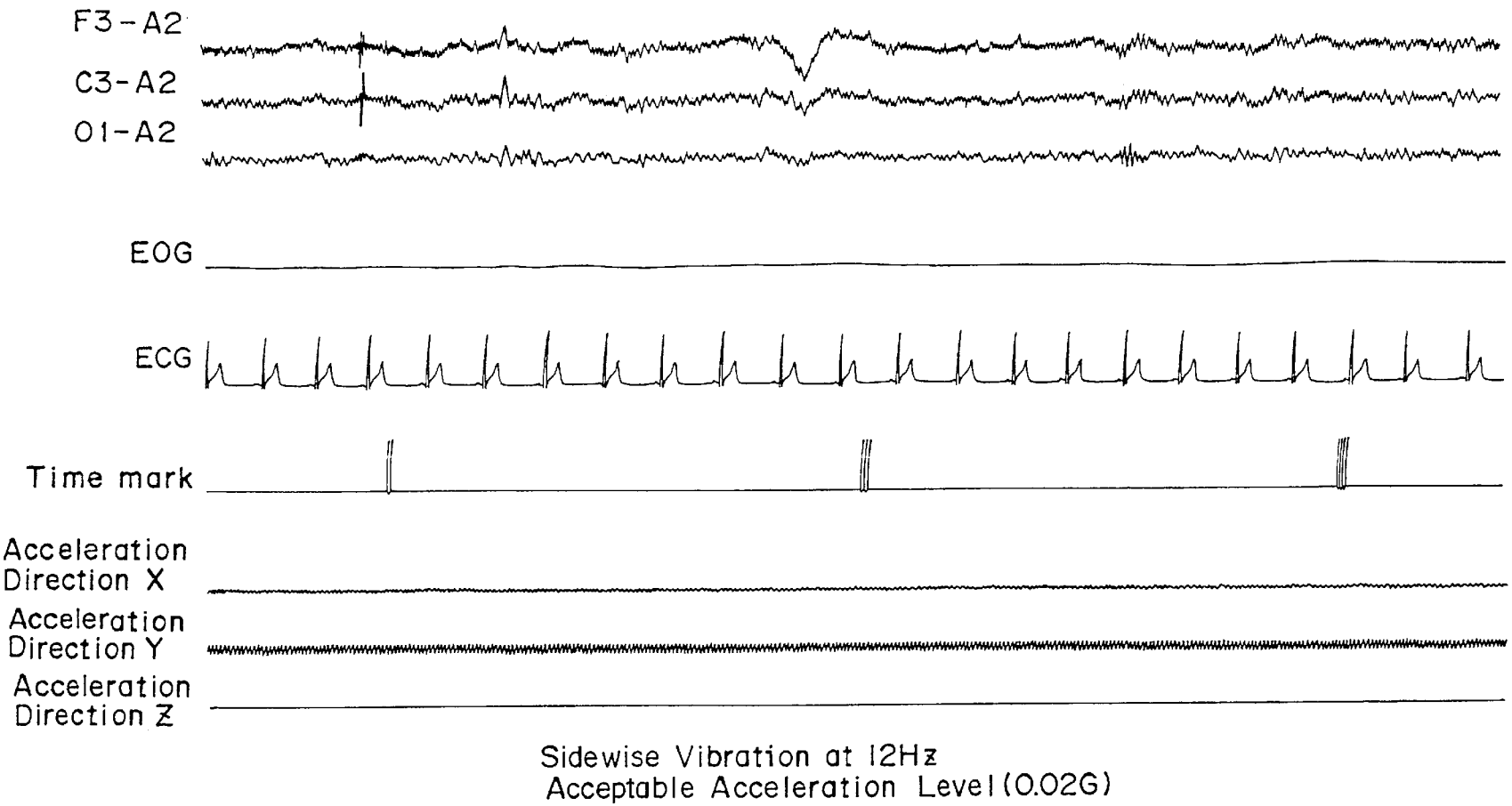
FIGS. 32A and 32B illustrate change in brain wave when the sidewise vibration of 12 Hz was applied with acceptable and unacceptable acceleration levels, respectively.
Figure 32B:
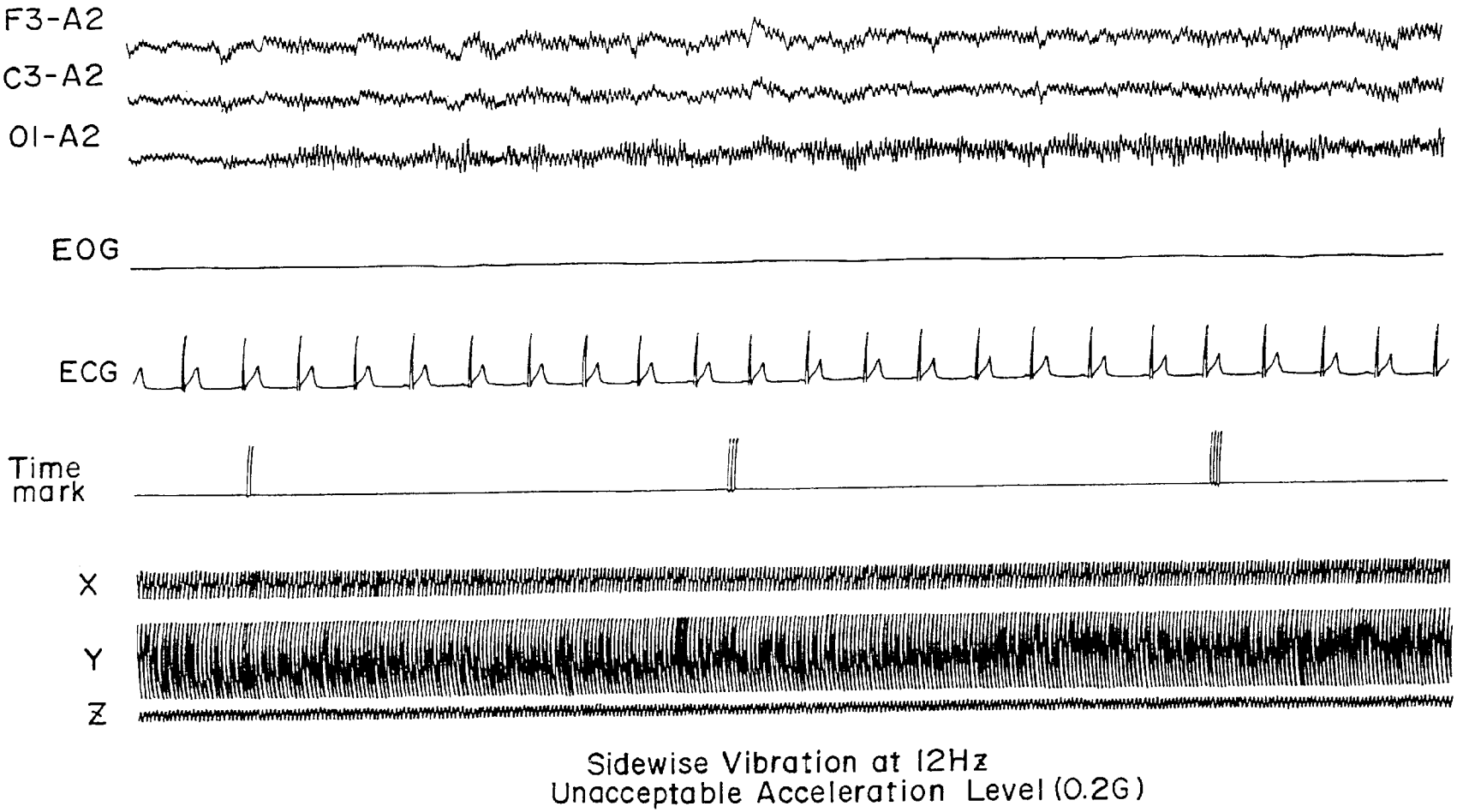
Figure 32C:
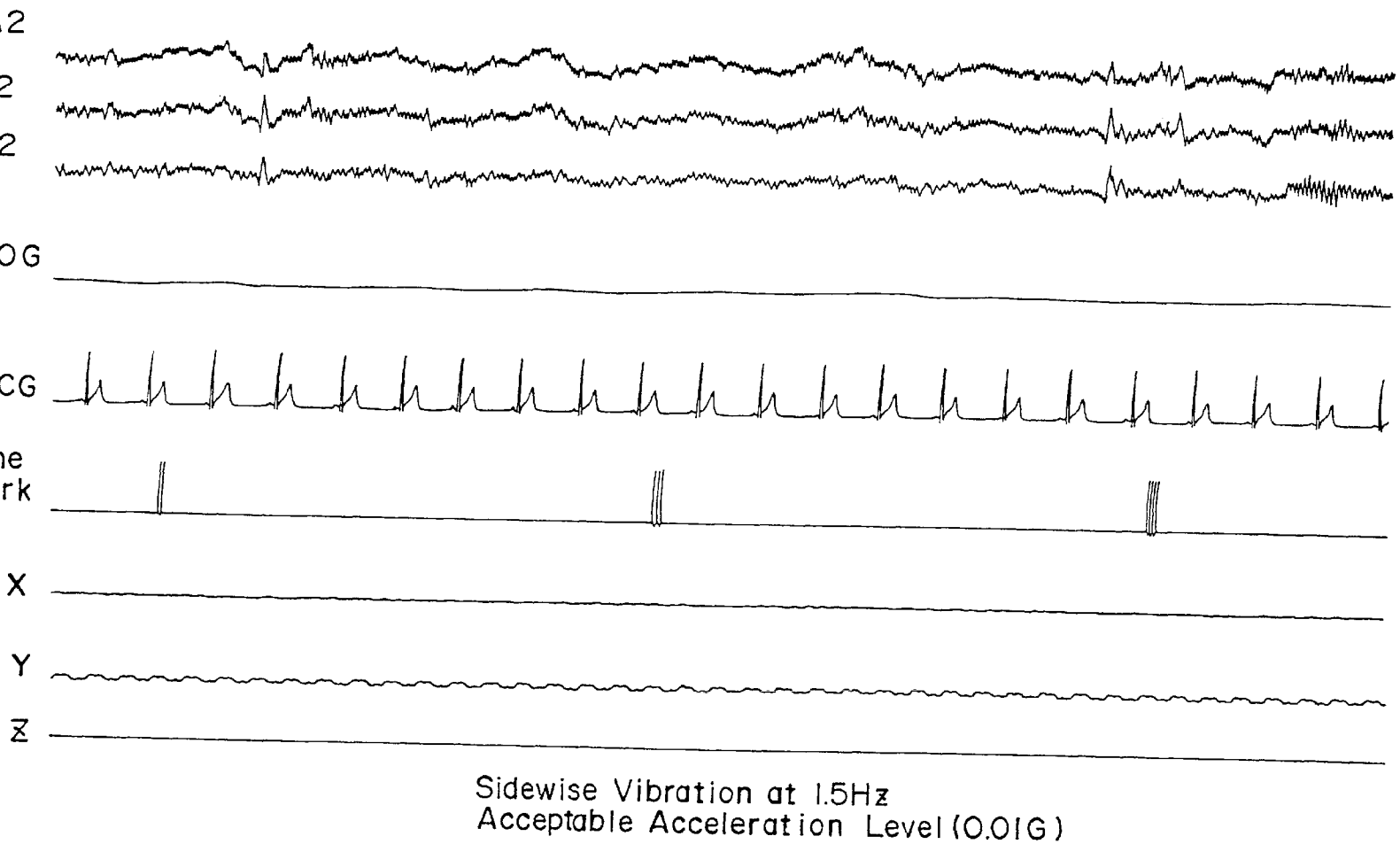
FIGS. 32C and 32D illustrate change in brain wave when the sidewise vibration of 1.5 Hz was applied with acceptable and unacceptable acceleration levels, respectively.
Figure 32D:
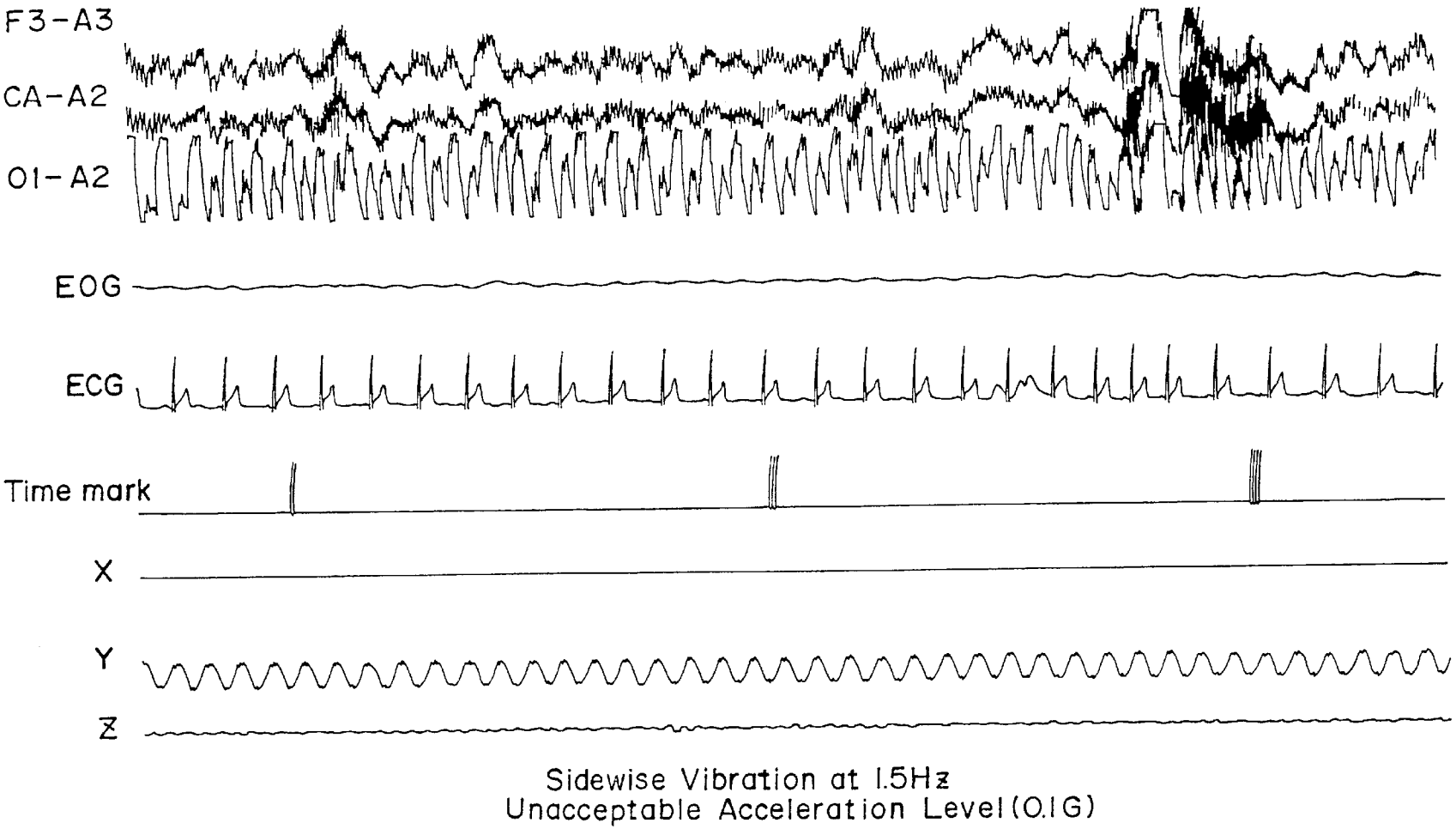
Figure 32E:
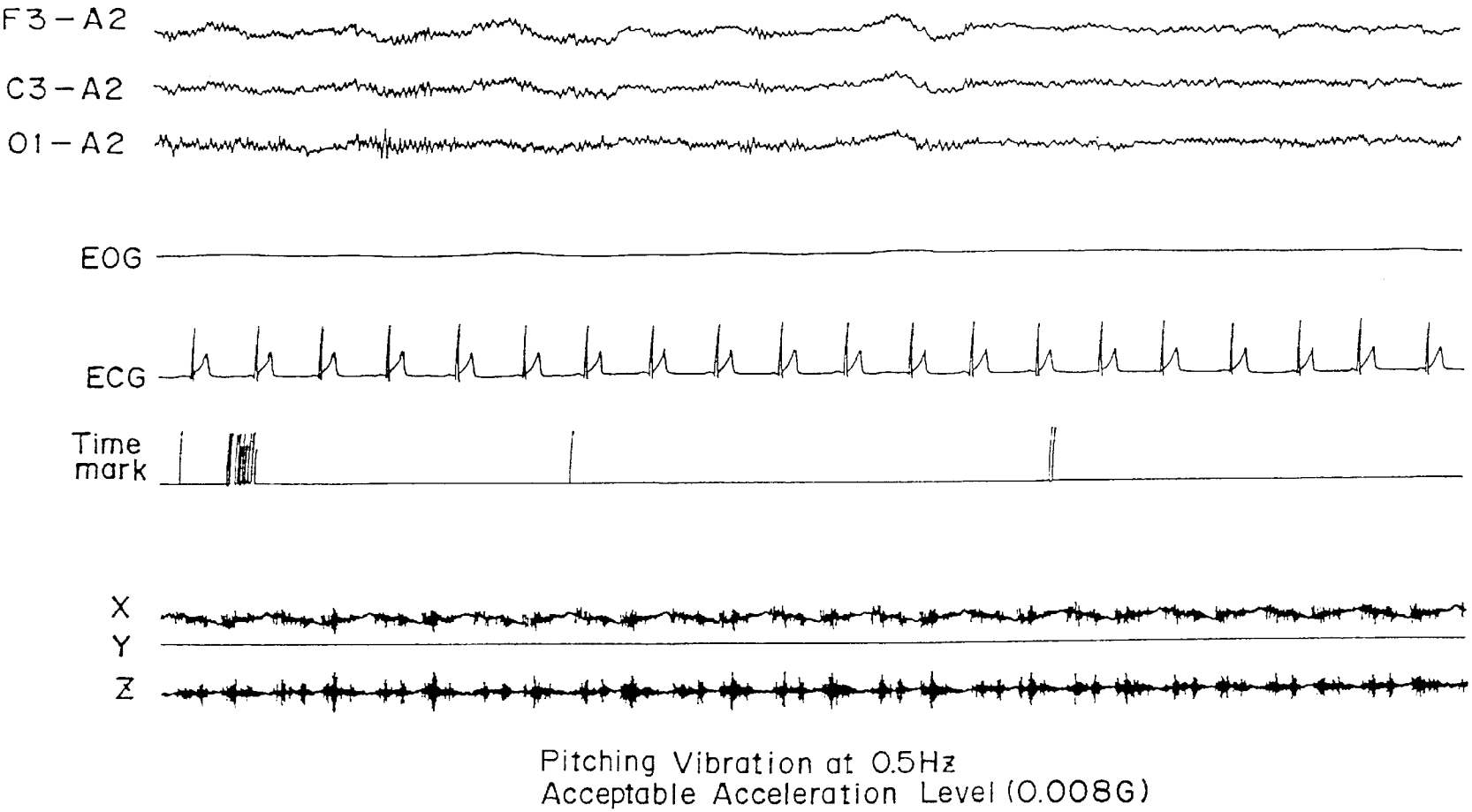
FIGS. 32E and 32F illustrate change in brain wave when the pitching vibration of 0.5 Hz was applied with acceptable and unacceptable acceleration levels, respectively.
Figure 32F:
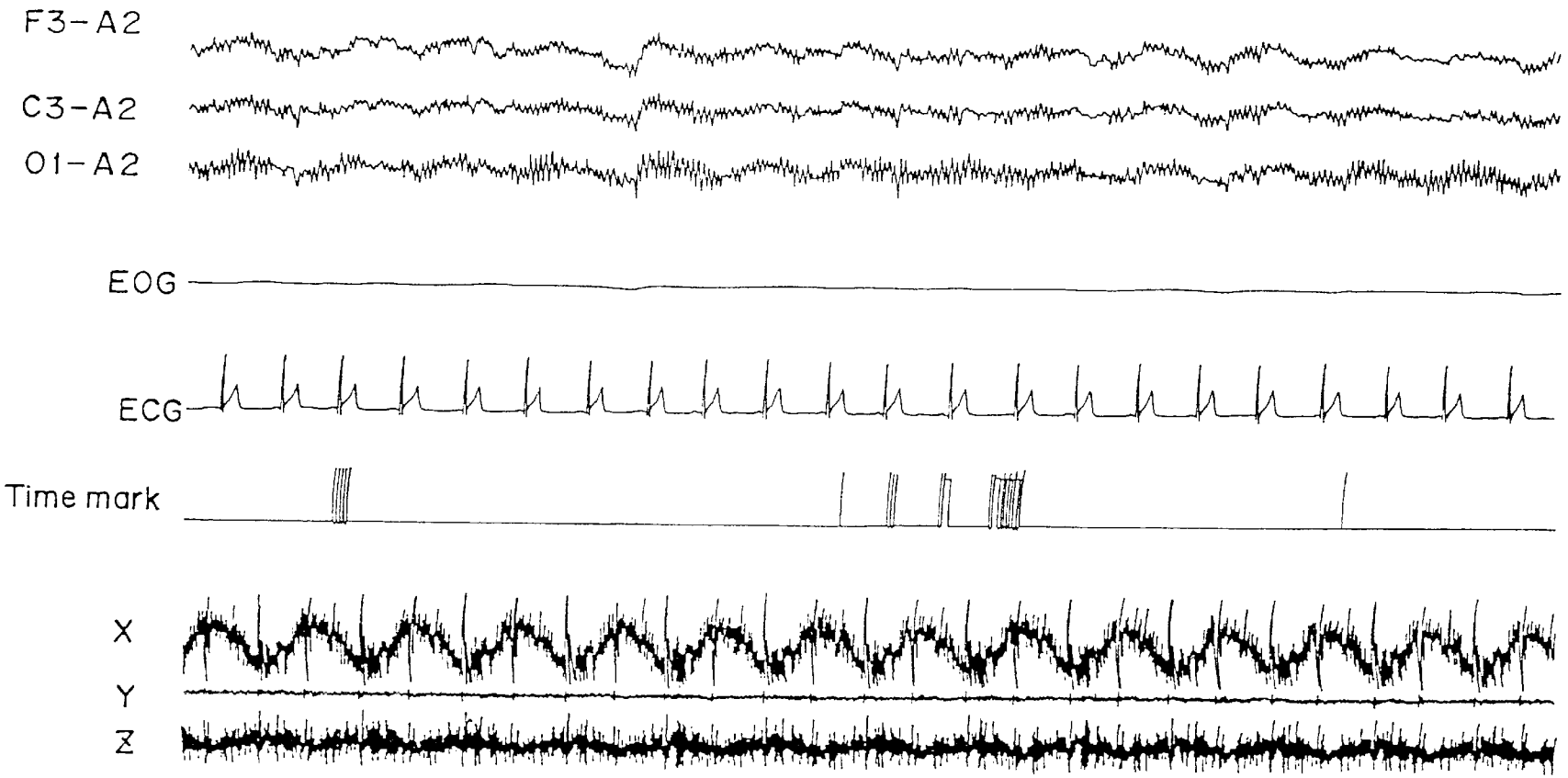

Change in brain wave shown in FIGS. 32A, 32C and 32E occurred when the acceleration level measured about 1.5 minute was low after rest state with no vibration for 1 minute, whereas change in brain wave shown in FIGS. 32B, 32D and 32F occurred when the acceleration level measured about 1.5 minute after rest state was high.

As is well known to those skilled in the art, the brain waves can be classified into α-wave, β-wave, θ-wave and hump. The α-wave is known to emerge when a person is in an awaking, quiet condition with the eyes closed; the β-wave is known to emerge when a person is in an awaking condition with the eyes opened or in a tension even though the eyes are closed; the θ-wave is known to emerge when a person is in a drowsy-to-sleep condition; and the hump is known to emerge from sleep stage 1 to sleep stage 2, especially in a stage of very light sleep. When a person is dozing, appearance of the α-wave is suppressed accompanied by substantial flattening of the brain waves, and as the person subsequently falls in a sound sleep, the θ-wave of a low amplitude in combination with fast waves emerges following the α-wave.

Under any of the experiment conditions, when the acceleration level was high as shown in FIGS. 32B, 32D and 32F, not only was the appearance of the β-waves lowered accompanied by increase of the appearance of the α-waves, but the frequency of the α-waves decreased. On the other hand, when the acceleration level was proper as shown in FIGS. 32A, 32C and 32E, not only did the appearance of the θ-waves become high, but the humps of a high amplitude emerged together with the β-waves, indicating that the subject was relieved.

Figure 33A:
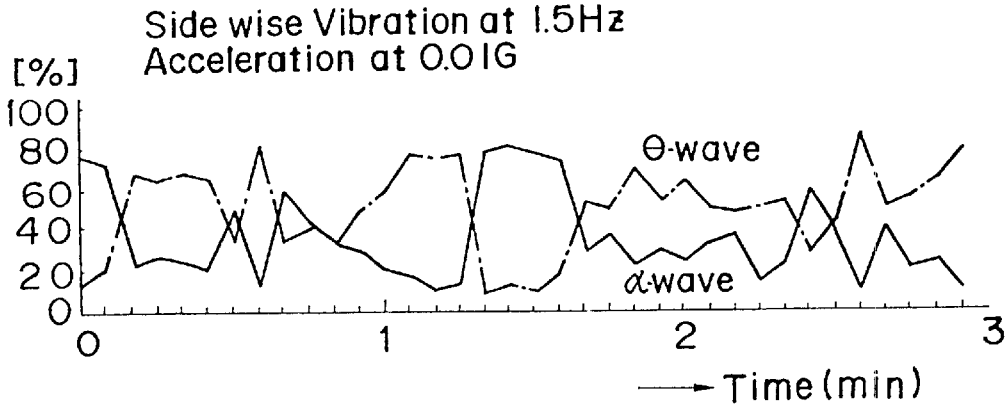
FIGS. 33A and 33B are graphs showing change in brain wave with passage of time when the acceleration level is proper and high, respectively.
Figure 33B:
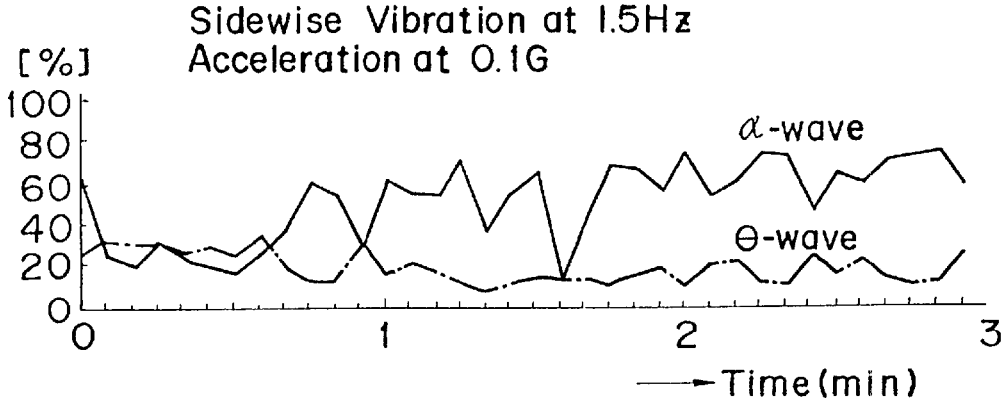

FIGS. 33A and 33B illustrate how the appearance rates of the α- and θ-waves changed with passage of time when the subject was exposed to the translational sidewise vibration of 1.5 Hz for three minutes. When the acceleration level was high, say, 0.1 G the rate of appearance of the α-waves was higher than, that is, about 2.5 times, the rate of appearance of the θ-waves as shown in FIG. 33B. On the other hand, when the acceleration level was low, say, 0.01 G, the rate of appearance of the θ-waves was considerably high and occupies about 50 to 80% during the latter half of the period of application of the vibration as shown in FIG. 33A.

Figure 34:
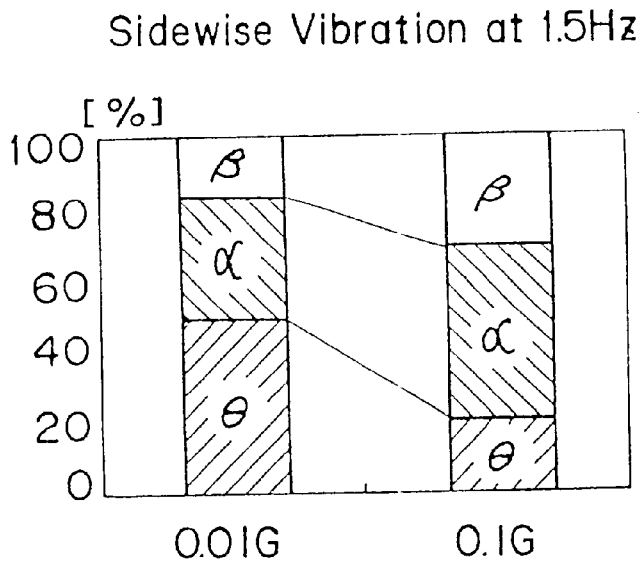
FIG. 34 is a graph showing the comparison of the rate of component of the various brainwaves between accelerations 0.01 G and 0.1 G in the case exposed sidewise vibration at 1.5 Hz.

The rates of appearance of the brain waves when the acceleration level was low (0.01 G) and high (0.1 G) during the period of 3 minutes in which the subject was exposed to the vibration are shown in FIG. 34 in the form of a bar graph. As clearly shown in FIG. 34, the rate of appearance of the θ-wave and that of the β-wave were about 50% and about 20%, respectively when the acceleration level was low, whereas the rate of appearance of the θ-wave and that of the β-wave were about 20% and about 30%, respectively, when the acceleration level was high. This is indicative of the fact that at the high acceleration level the subject was hardly relaxed.

Figure 35:
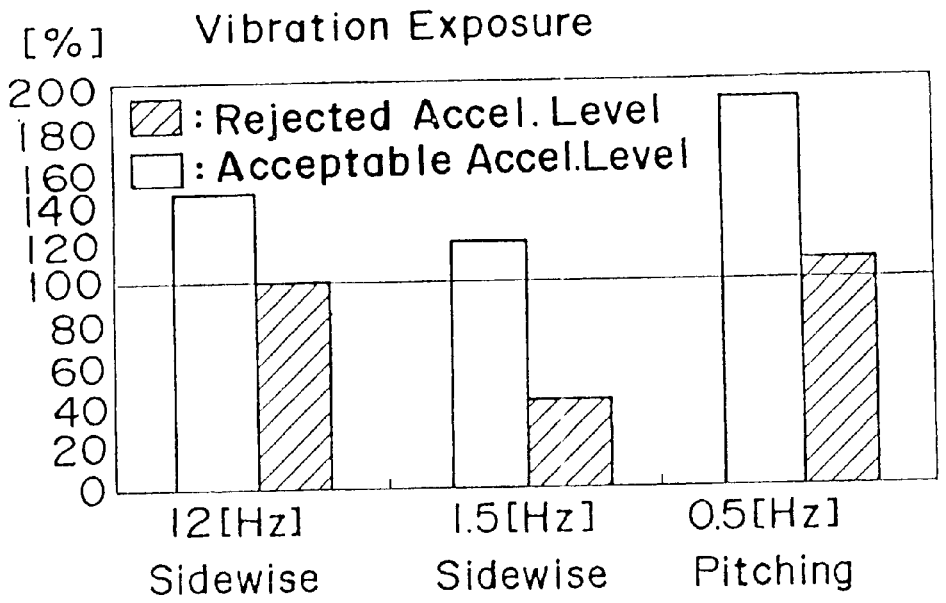
FIG. 35 is a graph showing the rate of appearance of the θ-wave under different vibrations of a different frequency.
Figure 36A:
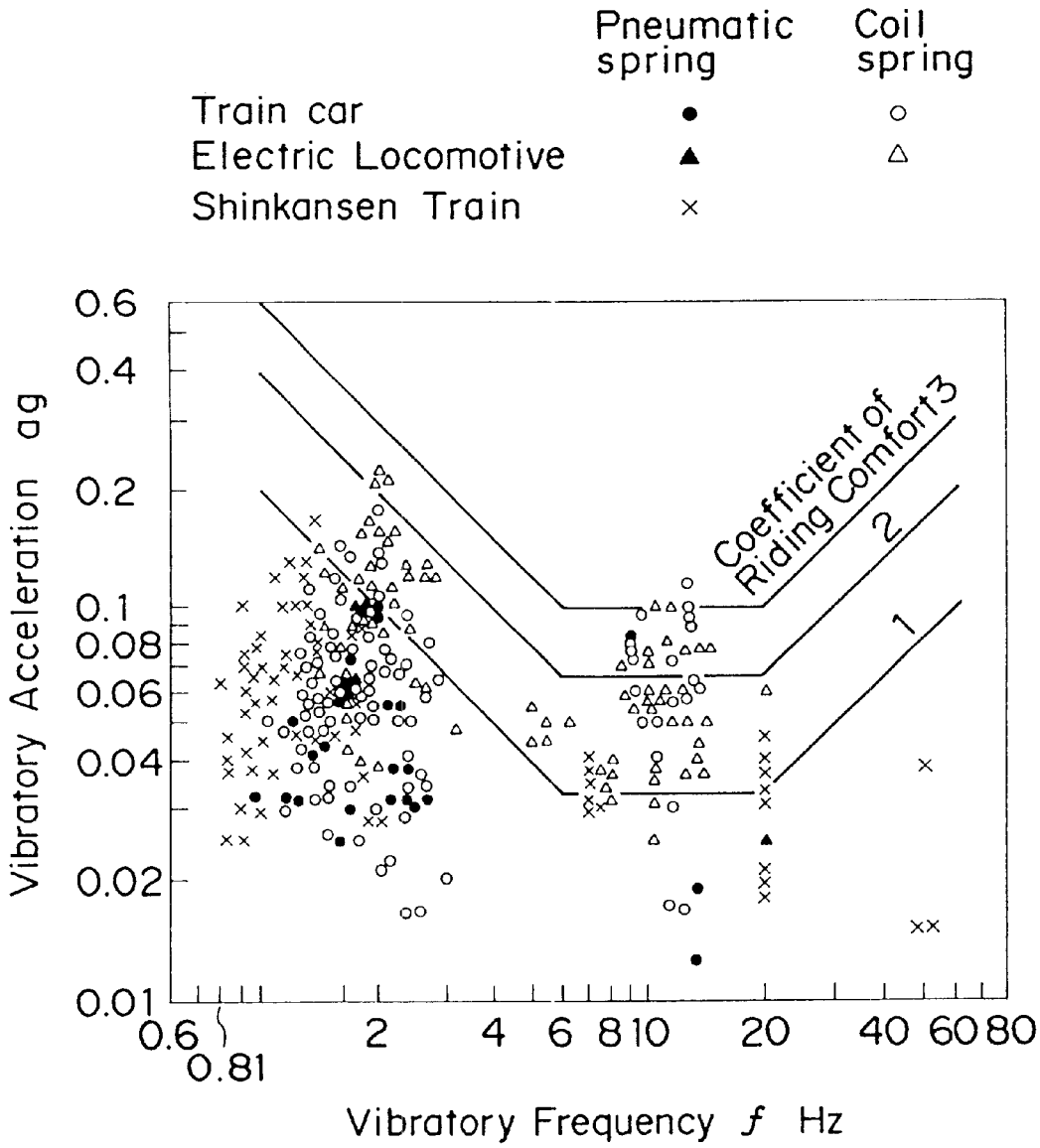
FIG. 36A is a graph showing the relationship between the frequency of vertical vibration occurring in the railway bogie car and the vibratory acceleration thereof.
Figure 36B:
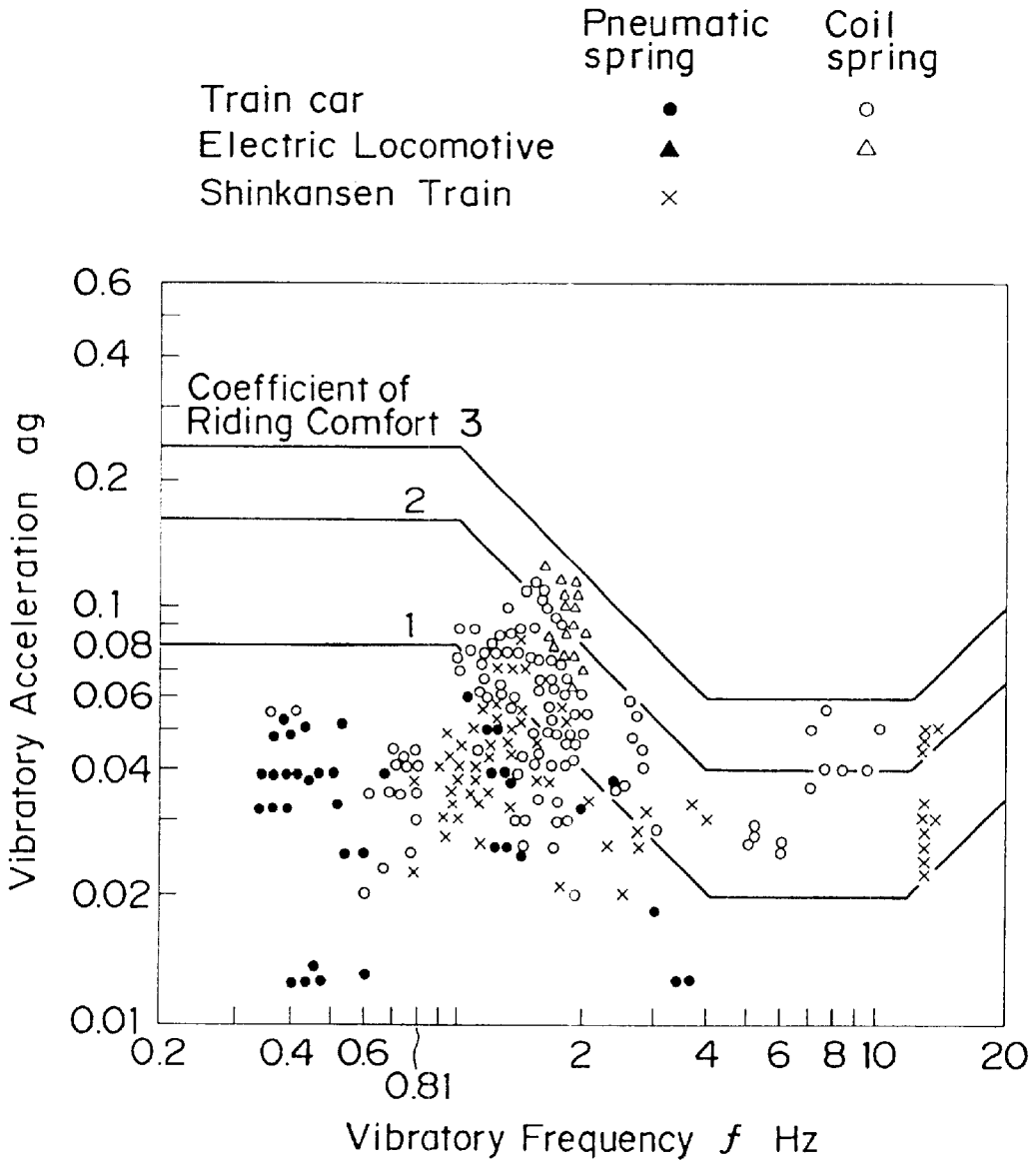
FIG. 36B is a graph showing the relationship between the frequency of horizontal vibration occurring in the railway bogie car and the vibratory acceleration thereof.
Figure 36C:
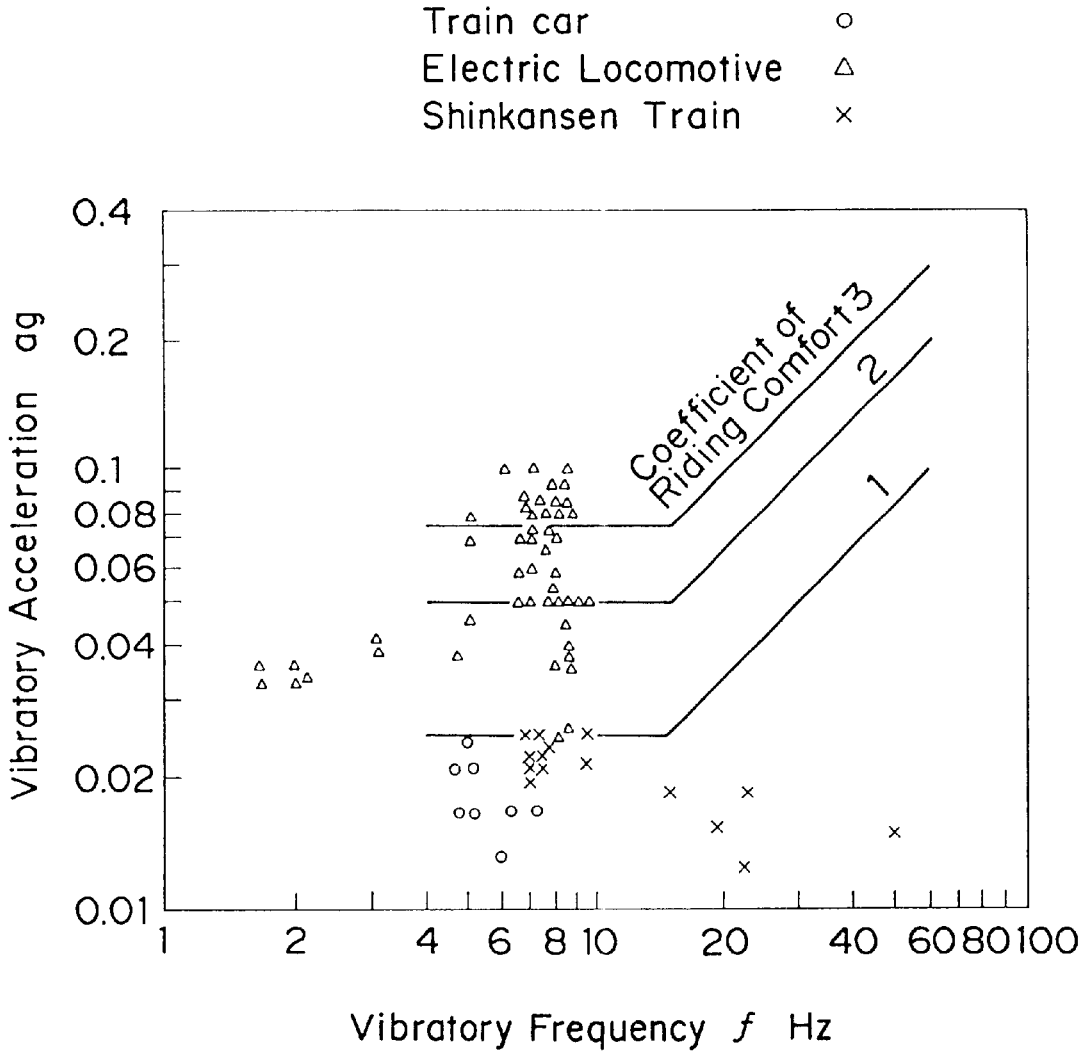
FIG. 36C is a graph showing the relationship between the frequency of linear vibration occurring in the railway bogie car and the vibratory acceleration thereof.

FIG. 35 illustrates the rates of appearance of the θ-wave, one of the brain waves which dominantly appears when the subject is lead from a relaxed state to a sleeping state, at different frequencies of vibration. In this graph of FIG. 35, 100% is assumed for the rate of appearance of the θ-wave when the subject was in a rest state with the eyes closed, and the left and right bars for each vibration frequency represent the respective rates of appearance of the θ-wave when the acceleration level was low and high. As can be understood from the graph of FIG. 35, at any one of the frequencies, that is, 12 Hz sidewise vibration, 1.5 Hz sidewise vibration and 0.5 Hz pitching vibration, the rate of appearance of the θ-wave was considerably low when the acceleration level was high, indicating that the subject was hardly relaxed as compared to the case when the acceleration level was low.

From the foregoing results of the experiments, it can be deduced that the acceleration level not greater than 0.1 G is appropriate to accomplish relaxation. It is to be noted that in the graph of FIG. 35, at 0.5 Hz the acceleration level is high, say, 0.04 G. Since 0.04 G is smaller than 0.1 G, it can be easily understood that when the acceleration level at 0.5 Hz becomes large compared to 0.1 G, it would be more difficult to accomplish relaxation than when the acceleration level is 0.04 G.

As hereinbefore fully described, the present invention requires that the frequency of vibrations applied to the body of the person occupying the support means and the effective acceleration acting on the body of the person being vibrated should not exceed 25 Hz and 0.1 G, respectively, and also have such a general relationship that the frequency of vibrations increases with increase of the effective acceleration, and vice versa. So long as these requirements are satisfied, the frequency of vibrations and the effective acceleration may be correlated with each other in any desired manner. For example, the frequency of vibration may be fixed at a value not exceeding 25 Hz, in which case the acceleration may be varied to a value not greater than 0.1 G in a manner shown by any of the curves (a) to (c) in FIG. 18, or the acceleration may be fixed at a value not exceeding 0.1 G in which case the frequency of vibration may be varied to a value not higher than 25 Hz in a manner shown by any of the curves (a) to (c) in FIG. 18. Alternatively, as shown in FIG. 19, either the frequency of vibrations or the acceleration may be maintained at a selected value not exceeding 25 Hz or 0.1 G, respectively, for a predetermined length of time and be subsequently decreased in any desired manner, for example, stepwise.

Although the present invention has been described in connection with the preferred embodiments thereof with reference to the accompanying drawings, it is to be noted that various changes and modifications are apparent to those skilled in the art. Such changes and modifications are to be understood as included within the scope of the present invention as defined by the appended claims, unless they depart therefrom.

What is claimed is:

1. A relaxation apparatus, comprising:

support means for supporting a whole body of a person, said support means comprising a reclining chair having a seat, a seatback tiltable relative to the seat, and a footrest tiltable to the seat;

vibrating means for vibrating the support means to vibrate the whole body of the person at a frequency not higher than 25 Hz; and control means for controlling the vibrating means such that the maximum acceleration of the vibration produced by the vibrating means to vibrate the person supported on the support means is not greater than 0.1 G and for controlling the acceleration in dependence on the frequency of vibrations outputted by the vibrating means such that said acceleration is small when the frequency of vibrations outputted by the vibrating means is low while the acceleration is large when the frequency of vibrations is high.

2. The relaxation apparatus as claimed in claim 1, wherein said vibrating means has a capability of vibrating the support means selectively in at least first and second planes perpendicular to each other; and wherein the vibration applied from the vibrating means to the support means and then to the body of the person is such that a portion of the body of the person adjacent the waist will not be pulled rearwards more than a predetermined level with respect to a position at which the vibrating means is started.

3. The relaxation apparatus as claimed in claim 1, wherein said support means is supported by a base, said support means when vibrated by the vibrating means allowing a head of the person being oscillated to traverse a curved trajectory that is downwardly curved towards the base.

4. The relaxation apparatus as claimed in claim 1, wherein said support means is supported by a base, said support means when vibrated by the vibrating means allowing a head of the person being oscillated to traverse a straight trajectory.

5. The relaxation apparatus as claimed in claim 1, wherein the vibration produced by the vibrating means acts directly on the whole body of the person and wherein said support means is movable in a direction conforming to a direction of propagation of vibrations transmitted by the vibrating means to the person.

6. The relaxation apparatus as claimed in claim 1, further comprising a relaxation sensor for detecting the degree of relaxation enjoyed by the person, an output from said relaxation sensor being used to vary a pattern of the vibration produced by the vibrating means.

7. The relaxation apparatus as claimed in any one of claims 1, further comprising at least one additional vibrating means for vibrating a local portion of the body of the person.

8. The relaxation apparatus as claimed claim 1, further comprising at least one of a heating means for heating the body of the person, a cooling means for cooling the body of the person, at least one auxiliary stimulus means for applying an auxiliary stimulus to the person in synchronism with the vibration, and a massaging means for massaging a local portion of the body of the person.

9. The relaxation apparatus as claimed in claim 1, wherein the frequency is fixed while the acceleration is variable.

10. The relaxation apparatus as claimed in claim 1, wherein the acceleration is fixed while the frequency is variable.

11. The relaxation apparatus as claimed in claim 1, wherein both the frequency and the acceleration are varied according to a pattern of vibration applied to the person.

12. A relaxation apparatus, comprising:

a support for supporting a whole body of a person, said support comprising a reclining chair having a seat, a seatback tiltable relative to the seat, and a footrest tiltable to the seat;

a vibrating mechanism for vibrating the support to vibrate the whole body of the person at a frequency not higher than 25 Hz; and a control mechanism for controlling the vibrating mechanism such that the maximum acceleration of the vibration produced by the vibrating mechanism to vibrate the person supported on the support is not greater than 0.1 G and for controlling the acceleration in dependence on the frequency of vibrations outputted by the vibrating mechanism such that said acceleration is small when the frequency of vibrations outputted by the vibrating mechanism is low while the acceleration is large when the frequency of vibrations is high.

13. The relaxation apparatus according to claim 12, further comprising a relaxation sensor for detecting the degree of relaxation enjoyed by the person, an output from said relaxation sensor being used to vary a pattern of the vibration produced by the vibrating mechanism.

14. The relaxation apparatus according to claim 12, wherein said support is supported by a base, said support when vibrated by the vibrating mechanism allowing a head of the person being oscillated to traverse a curved trajectory that is downwardly cured towards the base.

15. The relaxation apparatus according to claim 12, wherein said support is supported by a base, said support when vibrated by the vibrating mechanism allowing a head of the person being oscillated to traverse a straight trajectory.

* * * * *